US008242362B2

(12) United States Patent
Castaldo et al.

(10) Patent No.: US 8,242,362 B2
(45) **Date of Patent: *Aug. 14, 2012**

(54) TAMPER-RESISTANT ELECTRICAL WIRING DEVICE SYSTEM

(75) Inventors: Cosmo Castaldo, Westbury, NY (US); Azer Ilkhanov, Brooklyn, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/903,327

(22) Filed: Oct. 13, 2010

(65) Prior Publication Data

US 2011/0028011 A1 Feb. 3, 2011

Related U.S. Application Data

(63) Continuation of application No. 12/030,396, filed on Feb. 13, 2008, now Pat. No. 7,820,909, which is a continuation-in-part of application No. 11/470,995, filed on Sep. 7, 2006, now Pat. No. 7,355,117.

(60) Provisional application No. 60/715,081, filed on Sep. 8, 2005.

(51) Int. Cl.
*H01R 13/46* (2006.01)

(52) U.S. Cl. ..... 174/53; 174/58; 174/66; 439/145

(58) Field of Classification Search ..... 174/66, 174/67, 53, 135; 439/135, 136, 139, 142, 439/143, 145; 335/18; 361/42
See application file for complete search history.

(56) References Cited

U.S. PATENT DOCUMENTS

| | | | |
|---|---|---|---|
| 2,510,745 | A | 6/1950 | Kilgore |
| 2,540,496 | A | 2/1951 | Sperazza |
| 2,826,652 | A | 3/1958 | Piplack |
| 2,926,327 | A | 2/1960 | Metelli |
| 3,222,631 | A | 12/1965 | Cohen |
| 3,238,492 | A | 3/1966 | Houston |
| 3,617,662 | A | 11/1971 | Miller |
| 3,775,726 | A | 11/1973 | Gress |
| 3,986,763 | A | 10/1976 | Sparrow |
| 3,990,758 | A | 11/1976 | Petterson |
| 4,072,382 | A | 2/1978 | Reschke |

(Continued)

FOREIGN PATENT DOCUMENTS

| | | |
|---|---|---|
| GB | 2396489 | 6/2004 |

(Continued)

*Primary Examiner* — Dhirubhai R Patel
(74) *Attorney, Agent, or Firm* — Carter, DeLuca, Farrell & Schmidt, LLP

(57) ABSTRACT

A tamper-resistant electrical receptacle includes a cover defining a set of cover apertures; and a slider defining an aperture therein and being movable between a first position blocking the set of cover apertures and a second position not blocking the set of cover apertures, wherein when an object probes at least one and fewer than all of the set of cover apertures, the slider is constrained in the first position. When a set of prongs is inserted simultaneously through the set of cover apertures, the prongs contact a slider surface that is oriented substantially orthogonal to a longitudinal axis of the set of prongs such that the slider is urged from the first to the second position. When in the second position the slider aperture aligns with at least one of the set of cover apertures to enable the set of prongs to contact the receptacle contacts.

27 Claims, 25 Drawing Sheets

U.S. PATENT DOCUMENTS 4,148,536 A 4/1979 Petropoulsos et al.
4,168,104 A 9/1979 Bushow
4,271,337 A 6/1981 Barkas
4,379,607 A 4/1983 Bowden, Jr.
4,424,407 A 1/1984 Barbic
4,484,021 A 11/1984 Schaefer et al.
4,529,834 A 7/1985 Nattel
4,544,219 A 10/1985 Barkas
4,603,932 A 8/1986 Heverly
4,714,858 A 12/1987 Sanders
4,722,693 A 2/1988 Rose
4,867,693 A 9/1989 Gizienski et al.
4,867,694 A 9/1989 Short
4,897,049 A 1/1990 Miller et al.
4,909,749 A 3/1990 Long
4,936,789 A 6/1990 Ugalde
5,006,075 A 4/1991 Bowden, Jr.
5,020,997 A 6/1991 Calderara et al.
5,066,238 A * 11/1991 Shieh ..... 439/139
5,069,630 A 12/1991 Tseng et al.
5,277,607 A 1/1994 Thumma et al.
5,320,545 A 6/1994 Brothers
5,374,199 A 12/1994 Chung
5,391,085 A 2/1995 Tigner
5,518,132 A 5/1996 Chen
5,551,884 A 9/1996 Burkhart, Sr.
5,702,259 A 12/1997 Lee
5,839,909 A 11/1998 Calderara et al.
5,846,092 A 12/1998 Feldman et al.
5,902,140 A 5/1999 Cheung et al.
5,915,981 A 6/1999 Mehta
6,086,391 A 7/2000 Chiu
6,111,210 A 8/2000 Allison
6,149,446 A 11/2000 Yu
6,217,353 B1 4/2001 Yu-Tse
6,224,401 B1 5/2001 Yu
6,238,224 B1 5/2001 Shao
6,299,487 B1 10/2001 Lopata et al.
6,422,880 B1 7/2002 Chiu
6,537,088 B2 3/2003 Huang
6,537,089 B1 3/2003 Montague
6,734,769 B1 5/2004 Germain et al.
6,749,449 B2 6/2004 Mortun et al.
6,767,228 B2 7/2004 Katz
6,776,630 B1 8/2004 Huang
6,786,745 B1 9/2004 Huang
6,873,231 B2 3/2005 Germain et al.
6,884,111 B2 4/2005 Gorman
6,893,275 B2 5/2005 Ng et al.
6,896,530 B2 5/2005 Nishio et al.
6,932,631 B2 8/2005 Huang
6,943,297 B2 9/2005 Capella
6,949,994 B2 9/2005 Germain et al.
6,963,260 B2 11/2005 Germain et al.
6,969,801 B2 11/2005 Radosavljevic et al.
6,979,212 B1 12/2005 Gorman
6,986,674 B1 1/2006 Gorman
7,026,895 B2 4/2006 Germain et al.
7,088,205 B2 8/2006 Germain et al.
7,088,206 B2 8/2006 Germain et al.
7,114,968 B2 10/2006 Healy
7,129,413 B1 10/2006 Rao et al.
7,179,992 B1 2/2007 Packard et al.
7,227,435 B2 6/2007 Germain
7,312,394 B1 12/2007 Weeks et al.
7,312,963 B1 12/2007 Radosavljevic et al.
7,355,117 B2 4/2008 Castaldo et al.
7,439,833 B2 10/2008 Germain et al.
7,455,538 B2 11/2008 Germain
7,510,412 B1 * 3/2009 Valentin ..... 439/145
7,642,457 B2 * 1/2010 Weeks et al. ..... 174/53
8,063,303 B1 * 11/2011 McBain ..... 174/67
2002/0097546 A1 7/2002 Weinberger
2004/0203270 A1 10/2004 Wang
2006/0181373 A1 8/2006 Germain et al.
2007/0049077 A1 3/2007 Germain et al.
2007/0049079 A1 3/2007 Nalwad et al.
2007/0111569 A1 5/2007 Germain et al.
2007/0211397 A1 9/2007 Sokolow et al.
2008/0248662 A1 10/2008 Bazayev et al.
2009/0286411 A1 11/2009 Bazayev et al.

FOREIGN PATENT DOCUMENTS

WO WO 00/17728 3/2000

* cited by examiner

FIG. 8
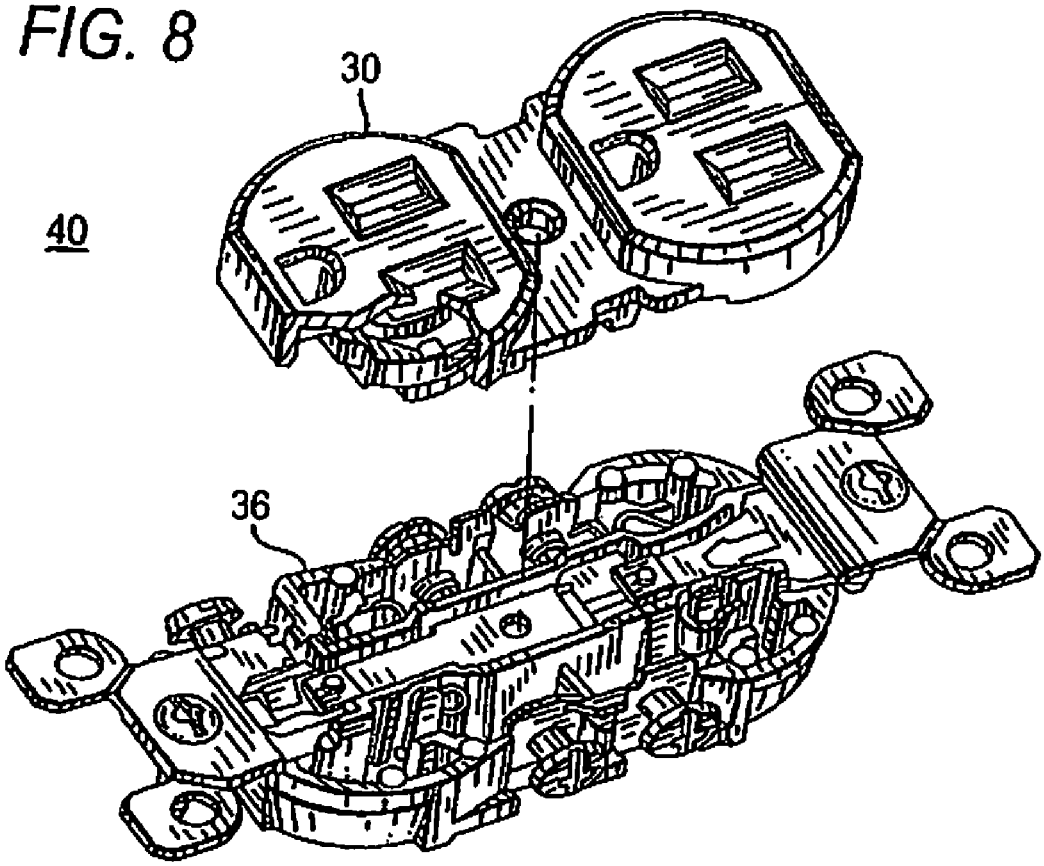
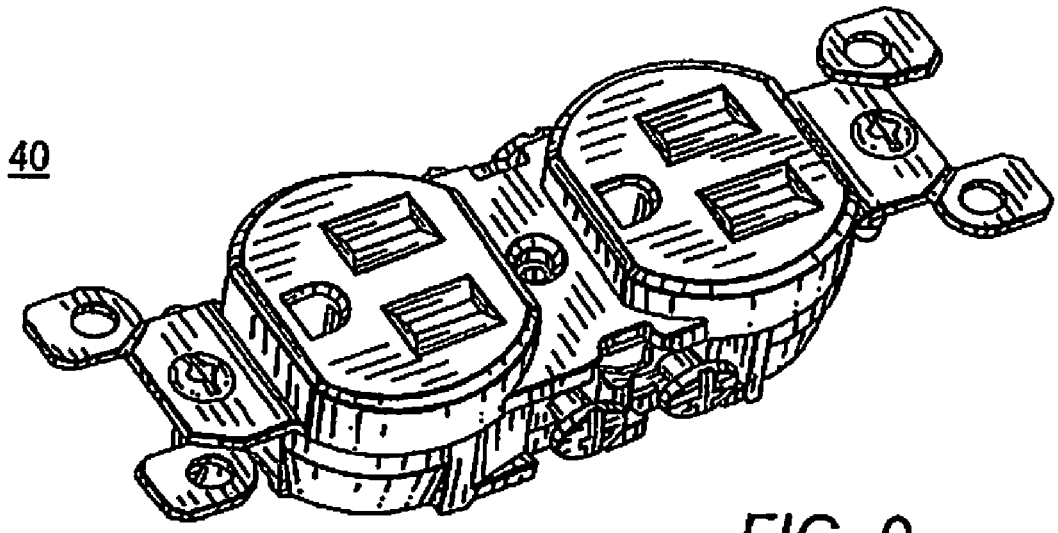
FIG. 9

300

300

TAMPER-RESISTANT ELECTRICAL WIRING DEVICE SYSTEM

CROSS-REFERENCE TO RELATED APPLICATIONS

The present application is a Continuation Application claiming the benefit of and priority to U.S. application Ser. No. 12/030,396, filed on Feb. 13, 2008 (now U.S. Pat. No. 7,820,909), which is a Continuation-in-Part Application claiming the benefit of and priority to U.S. application Ser. No. 11/470,995, filed on Sep. 7, 2006, now U.S. Pat. No. 7,355,117 which in turn claims the benefit of and priority to U.S. Provisional Application Serial No. 60/715,081, filed on Sep. 8, 2005, the entire content of each of which being incorporated herein by reference.

FIELD OF THE INVENTION

1. Technical Field

The present invention relates to electrical receptacles, and, more particularly, to a tamper-resistant electrical wiring device system.

2. Background of the Invention

Electrical power transmitted from a source to a point of use through an electrical distribution system within a home or a commercial building for equipment and operations is a beneficial service. Conventional electrical receptacles within such a distribution system include a pair of slots or apertures aligned with contacts, wherein prongs of an electric plug may be inserted in the pair of apertures to directly engage contacts within the receptacle in an effort to facilitate a desired electrical connection. Since a large percentage of these receptacles are used in residential buildings and are located near the floor, a young child or infant, for example, may insert a small object into either one of the apertures which potentially may result in electrical shock. More particularly, a burn or shock may result when a child's wet mouth enables electrical contact, wherein a path exists from the hot contact through the child to ground, establishing a ground fault.

Besides a child's fingers and mouth, children may insert into receptacles a wide variety of objects made of conductive material including but not limited to a metal articles. Most objects may be everyday household and easily accessible items such as, paper clips, pens wire tools, hairpins, safety pins, keys, forks, knives, screws, nails, tweezers and coins. Since some of these objects may be perceived by parents as safe, parents tend not to restrict access to many of these objects.

Both scenarios present circumstances to be avoided, where possible. As such, the issue of human safety and avoiding hazards has always been considered by the owner of the instant application in developing new products. Further, in an effort to eliminate the foregoing, the National Electrical Code (NEC) now requires tamper-proof electrical receptacles in pediatric environments since electrical shocks often occur in these types of environments. Research studies have shown that many of these incidents happen around meal time, when parents are occupied in the kitchen and children are not well supervised. A National Electrical Manufacturer's Association (NEMA) task force has concluded that every residential building should be required to have tamper-resistant electrical receptacles and ground fault circuit interrupters (GFCI) designed within the electrical distribution system throughout the home.

Presently available circuit interrupter devices, such as the device described in commonly owned U.S. Pat. No. 4,595, 894, which is incorporated herein in its entirety by reference, use a trip mechanism to mechanically break an electrical connection between one or more input and output conductors. Such devices are resettable after they are tripped after the detection of a ground fault. The ground fault circuit interrupter, however, only disconnects the circuit after electrical contact is made with a conductor. Thus, without a tamper resistant electrical receptacle, a person may still experience an initial temporary shock.

Numerous child-proof devices have been proposed or are commercially available which are directed to preventing a child from touching the apertures in a receptacle assembly or preventing a child from inserting or removing an electrical plug in or from the apertures. No such device, however, has achieved wide acceptance; therefore, the aforementioned condition remains today. This is primarily due to ineffectiveness of each device, expense, and the lack of ease of use. Foremost among these drawbacks is one of expense. That is, there are conventional devices that may be applied to various receptacles with safety features. However, the added expense required to manufacture such receptacles outweighs the safety advantage.

Prior patents featuring safety electric receptacles have generally comprised attachments for the face plate of an electric receptacle featuring rotatable snap-on or sliding covers for the electric socket opening, such as disclosed by U.S. Pat. Nos. 3,639,886 and 3,656,083 in which the face plate attachments are manually moved for insertion and removal of the plug. These attachments, such as plastic receptacle caps, are generally designed to include plastic plates having a pair of wall receptacle aperture engaging blades. These plastic receptacle caps, however, are unreliable and inefficient. Research in 1997 by the Temple University Biokinetics Laboratory in Philadelphia showed that 47% of the 4 year olds in a test group were able to remove one brand of receptacle caps. For another similar embodiment of a receptacle cap, 100% of the children within the age group of 2 to 4 years of age were able to remove the receptacle cap in many cases in less than 10 seconds. Other disadvantages of plastic receptacle caps include but are not limited to the forgetfulness of adults to reinsert the caps. In addition, receptacles are susceptible to being exposed to a child who may pull a lamp cord, leaving the receptacle unprotected. Furthermore, constant pressure from the plastic blades on the receptacle contacts increase contact distortion, increasing the risk of loose contacts and/or creating poor contacts, resulting in plugs falling out of the receptacle. Moreover, many of the plastic receptacle caps may create choking hazards, since they may fail to pass a choke hazard test described in a UL standard.

Other patents, such as U.S. Pat. Nos. 2,552,061 and 2,610,999 feature overlying slotted slidable plates which must be manually moved to mate the overlying plate slots with the electric receptacle slots or openings for insertion and removal of the plug. Sliding shutter plates offer a better level of protection than receptacle caps. However, none of the sliding shutter plates that are on the market are UL listed. This is primarily due to the fact that they add extra layers of material between the plug prongs and the receptacle contacts which reduces the surface of contact between plug prongs and contacts, causing potential heat rise or arcing which may also be hazardous. Another disadvantage of a manually movable face plate is that a small child, by observation, may learn to expose the electric receptacle.

Thus, a need exists for an simple, effective, efficient, low-cost electrical receptacle that is tamper-proof and does not need continuous manual adjustment. This device must prevent electric shock when one inserts a conductive instrumentality other than the plug of an appliance, while still permitting full surface contact between the plug prongs and contacts and frequent insertion and removal of prongs.

The present invention is directed to overcoming, or at least reducing the effects of one or more of the problems set forth above.

SUMMARY OF THE INVENTION

To address the above-discussed deficiencies of child-proof devices for electrical receptacles, the present invention teaches a tamper resistant electrical receptacle that has a simple, effective, efficient, low-cost design that does not need continuous manual adjustment. This device prevents electric shock when one inserts an object into one aperture in the cover, while still permitting the frequent insertion and removal of plugs to an electrical appliance.

Specifically, a tamper resistant electrical receptacle in accordance with the present invention includes a base assembly that connects to a cover assembly, wherein the cover assembly having at least one pair of cover apertures, includes a slider positioned in a first position to block entry into the cover assembly when an object is inserted into only one cover aperture (the typical scenario for children probing electrical receptacles). When, however, a pair of prongs are inserted into the electrical receptacle, the slider shifts out of the way into a second position that enables the pair of prongs to engage the receptacle terminals located in the base assembly. Access to the receptacle terminals is thus prevented significantly reducing the likelihood of electric shock due to contact with these terminals.

A first embodiment of the tamper-resistant electrical receptacle for electrical connection between an appliance having a pair of prongs and a power distribution system includes a base assembly attached to a cover assembly. The cover assembly includes a cover having at least one pair of apertures for at least one pair of prongs of an external electrical plug to be inserted therethrough. The apertures in the cover assembly align with receptacle terminals in the base assembly. The cover assembly further includes at least one slider that rests in the cover behind one pair of the apertures. The slider is held in a first position wherein the slider covers both apertures of the cover such that an object is blocked from entering into either of the pair of apertures in the cover and, thereby, prevents access to the receptacle terminals. The slider is restricted to the first position when an object probes only one aperture in the cover. This first position is maintained until a pair of prongs are inserted into the pair of apertures causing the slider to slide into a second position allowing the pair of prongs to pass through the pair of apertures in the cover and enabling each prong to engage a respective one of the receptacle terminals. In this second position, the width of the slider is selected such that when the slider moves into this position the aperture covers are no longer covered and blocked by the slider. Thus, the receptacle terminals are fully accessible to the pair of prongs in the second position. After the pair of prongs are removed from the receptacle terminals, the slider automatically retracts to the first position where access to the receptacle terminals is blocked.

Another embodiment of the tamper-resistant electrical receptacle for electrical connection between an appliance and a power distribution system includes a base assembly attached to a cover assembly, wherein the apertures in the cover assembly align with the receptacle terminals in the base assembly. The cover assembly includes a cover having at least one pair of apertures for at least one pair of prongs of an external electrical plug to be inserted therethrough. The cover assembly further includes at least one platform sub-assembly, wherein each platform sub-assembly rests in the cover behind one pair of the apertures. The platform sub-assembly includes a slider, a platform, and a leaf spring. The slider rests in the platform and is held into position by a leaf spring that is in juxtaposition with the slider.

The leaf spring is used to load the slider in a first position where the slider covers both apertures in the cover such that an object is blocked from entrance into either of the pair of apertures in the cover. The leaf spring, the platform and the cover confine the slider in the first position when an object probes only one aperture in the cover. This first position is maintained until the pair of prongs are inserted into the pair of apertures causing the slider to slide into a second position allowing the pair of prongs to pass through the pair of apertures in the cover so that each prong engages a respective one of the receptacle terminals. In this second position, the slider is designed to be just wide enough to allow the receptacle prongs access to the pair of prongs. After the pair of prongs are removed from the receptacle terminals, the leaf spring automatically retracts the slider to the first position, in which access to the receptacle terminals is blocked.

Another embodiment of the tamper-resistant electrical receptacle of the present invention includes a base assembly attached to a cover assembly, wherein the apertures in the cover assembly align with the receptacle terminals in the base assembly. The cover assembly includes a cover having at least one pair of apertures for at least one pair of prongs of an external electrical plug to be inserted therethrough. The cover assembly further includes at least one platform sub-assembly, wherein each platform sub-assembly rests in the cover behind one pair of the apertures. The platform sub-assembly includes a slider, a platform, and a leaf spring. The slider having a slider aperture rests in the platform and is held in position by the leaf spring that is positioned juxtaposed to the slider for loading the slider into a misaligned position where the slider aperture is misaligned with respect to the aperture in the cover such that an object is blocked from entering into either of the apertures in the cover.

The leaf spring, the platform and the cover confine the slider in the misaligned position when an object probes only one aperture in the cover. This misaligned position is maintained until a pair of prongs are inserted into the pair of apertures, causing the slider to slide into an aligned position wherein the slider aperture aligns with one of the pair of apertures of the cover, thereby enabling a first prong to slip through both the cover aperture and the slider aperture, and a second prong to slip through the other cover aperture and bypassing the slider. In this alignment position, the slider is designed to be just wide enough so that the when the slider aperture aligns with one aperture in the cover, the slider does not cover the other respective aperture. Upon removal of the pair of prongs from the receptacle terminals, the leaf spring urges the slider back into the misaligned position.

Another embodiment of the tamper-resistant electrical receptacle of the present invention includes a base assembly attached to a cover assembly, wherein the apertures in the cover assembly align with the receptacle terminals in the base assembly. The cover assembly includes a cover having at least one pair of apertures for at least one pair of prongs of an external electrical plug to be inserted therethrough. Moreover, the cover includes an upper rib formed on the interior surface of the cover. The cover assembly further includes at least one platform sub-assembly, wherein each platform sub-assembly rests in the cover behind one pair of the apertures. The platform sub-assembly includes a slider, a platform, and a leaf spring. The slider having a slider aperture rests in the platform and is held in position by a leaf spring that is positioned juxtaposed to the slider for loading the slider into a misaligned position where the slider aperture is misaligned with respect to the aperture in the cover such that an object is blocked from entrance into either of the pair of apertures in the cover.

The platform includes a lower rib formed on its interior surface. When an object is inserted into only one first aperture of the cover, the upper rib formed on the interior surface of the cover blocks movement of the slider from transitioning from the misaligned position into an align position wherein the receptacle terminals are left open and accessible. In the alternative when an object is inserted into only one second aperture of the cover, the lower rib formed on the interior surface of the platform blocks movement of the slider from transitioning from the misaligned position into an align position wherein the receptacle terminals are left open and accessible. Thereby the upper rib of the cover and the lower rib of the platform confine the slider to the misaligned position when an object probes only one aperture in the cover. This misaligned position is maintained until the pair of prongs are inserted into the pair of apertures causing the slider to slide into an aligned position where the slider aperture aligns with one of the pair of apertures in the cover enabling a first prong to slip through both the aperture and the slider aperture, and a second prong to slip through a corresponding one of the pair of apertures bypassing the slider.

In the alignment position, the slider is designed to be just wide enough so that when the slider aperture aligns with one aperture in the cover, the slider does not cover the other aperture. After the pair of prongs are removed from the receptacle terminals, the leaf spring moves the slider back into the misaligned position.

Advantages of this design include but are not limited to, a tamper-resistant electrical receptacle that is permanent in that once the unit is installed it offers protection for the life of the building structure. The tamper-resistant electrical receptacle in accordance with the present invention is reliable since this receptacle is not manually removable. In addition, a user need not be concerned about losing the associated part that makes the electrical receptacle tamper-resistant. Further, a user needs to be concerned with breaking the tamper-resistant electrical receptacle because the platform sub-assembly is secured behind the cover of the electrical receptacle. Moreover, the tamper-resistant electrical receptacle provides automatic protection even when a plug is removed because the spring loaded slider retracts back to the closed position for immediate protection.

These and other features and advantages of the present invention will be understood upon consideration of the following detailed description of the invention and the accompanying drawings.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 8 illustrates an exploded view of the base and cover assembly in accordance with the present invention;

FIG. 9 displays the tamper resistant assembly in accordance with the present invention;

DETAILED DESCRIPTION OF PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
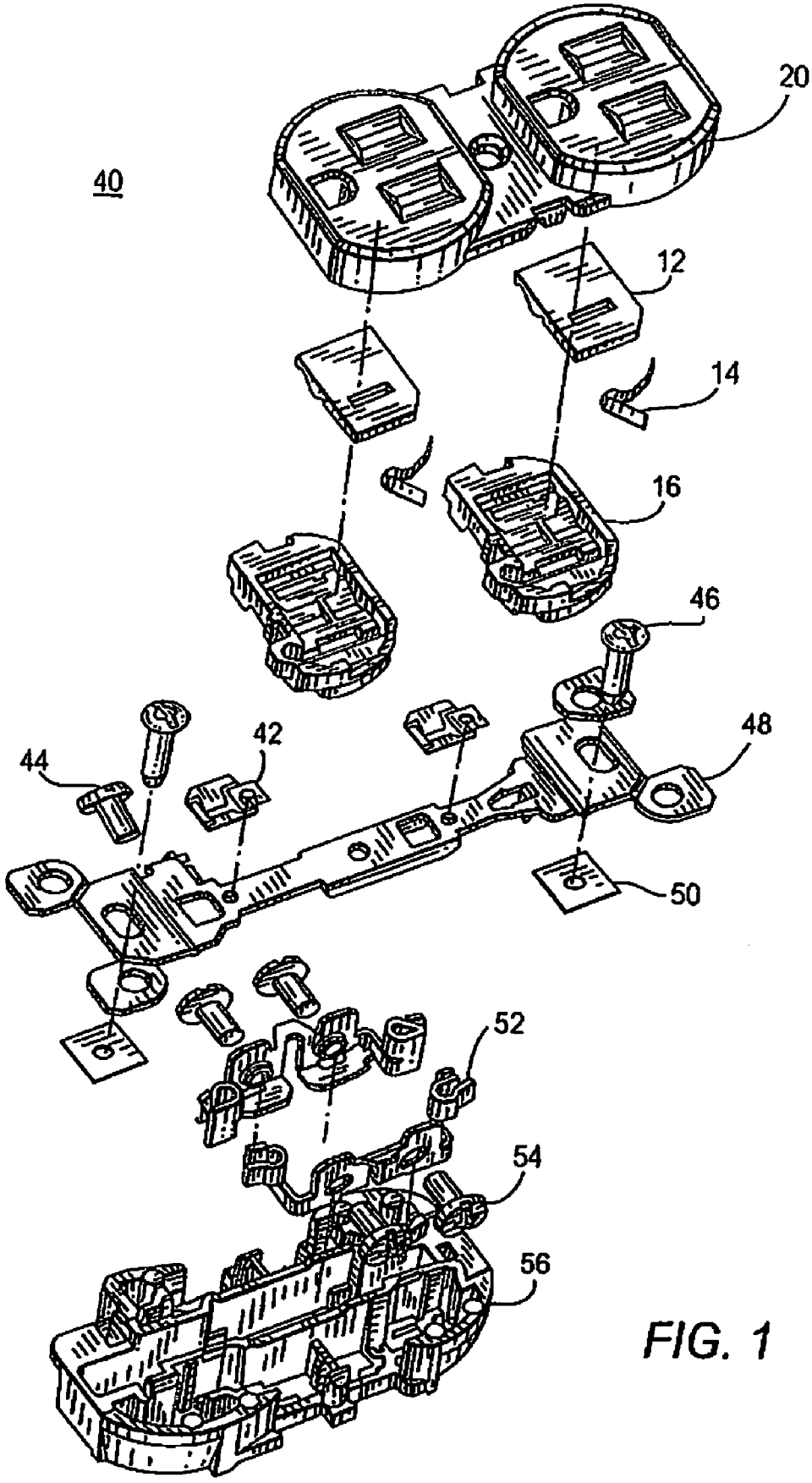
FIG. 1 shows an exploded view of a 15 ampere embodiment of the tamper resistant assembly in accordance with the present invention.

Specifically, a tamper resistant electrical receptacle in accordance with the present invention includes a base assembly that connects to a cover assembly, wherein the cover assembly includes a platform sub-assembly having a platform, a slider, and a leaf spring. The slider positioned is placed in a first position to block entry into the cover assembly when an object is inserted into only one cover aperture which is the typical scenario for children probing electrical receptacles. When, however, a pair of prongs are inserted into the electrical receptacle, the slider shifts out of the way into a second position that enables the pair of prongs to engage receptacle terminals located in the base assembly. Thereby, this electrical receptacle effectively prevents electric shock FIGS. 1-14*b* illustrate a first embodiment of the tamper resistant receptacle 40 in accordance with the present invention. Specifically, FIG. 1 shows an exploded view of the tamper resistant electrical receptacle 40 in accordance with the present invention. The receptacle 40, as shown in FIG. 1, is a duplex three-prong electrical receptacle for handling 15 amp current applications. However, it should be understood that the receptacle can be a two or three-prong electrical receptacle or a receptacle other than that of a duplex receptacle.

As shown in FIG. 1, cover 20 sits on top of a pair of platform sub-assemblies including platform 16, leaf spring 14 and slider 12. Mounting screws 46 mount strap 48 onto the base 56 using retaining washers 50. Ground contacts 42 connect onto strap 48. Finally, contacts 52 connect to the base 56 using terminal screws 54 to form the receptacle terminals in base 56.

Figure 2:
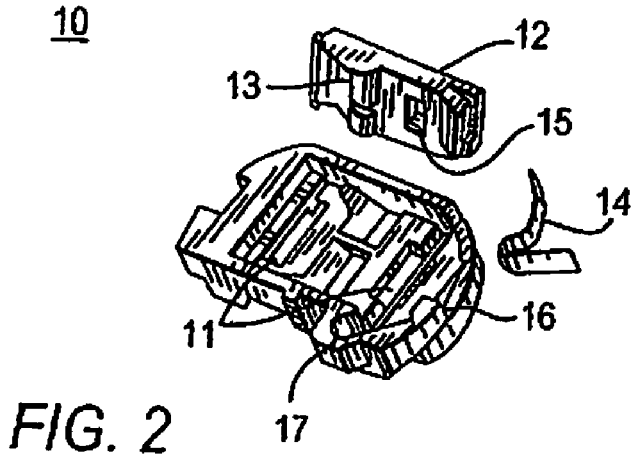
FIG. 2 illustrates an exploded view of a 15 ampere embodiment of the platform sub-assembly in accordance with the present invention.
Figure 14A:
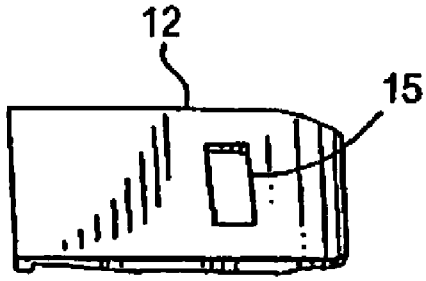
FIGS. 14*a* and 14*b* illustrate the front and back side of the slider in accordance with one embodiment of the present invention.
Figure 14B:
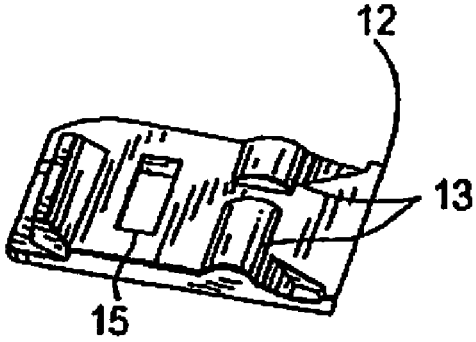

Specifically, referring to FIG. 2, an exploded view of the platform sub-assembly includes a slider 12, a leaf spring 14, and a platform 16. Slider 12 includes at least one rib 13. It is noted that rib 13 may be one or more projections as shown in FIGS. 2 and 14*b*. A slider aperture 15 is included in slider 12 to enable one prong to be inserted through to make contact with the receptacle terminals in the base of the tamper resistant receptacle 40. The cover 20 may include at least one pair of apertures. As such, slider aperture 15 must align with at least one of the apertures from an aperture pair of cover 20 to enable a prong to pass through the slider aperture 15 to a receptacle terminal which shall be explained in further detail.

Figure 3:
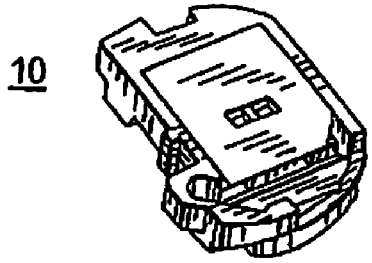
FIGS. 3, 7*a*, and 7*b* display the platform sub-assembly completely assembled in accordance with the present invention.
Figure 5A:
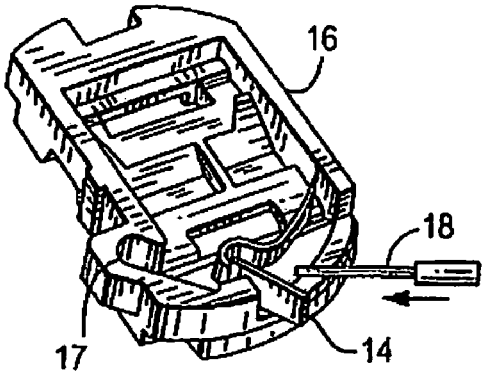
FIGS. 5*a* and 5*b* display two views of the leaf spring placement by a suitable tool into the platform in accordance with the present invention.
Figure 5B:
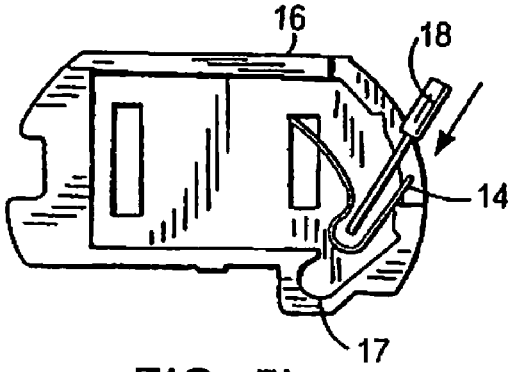
Figure 6A:
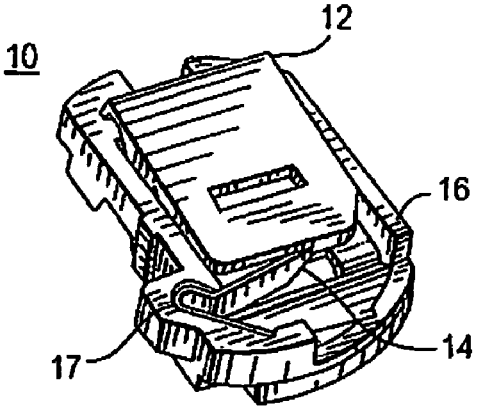
FIGS. 6*a* and 6*b* illustrate the placement of the slider into the platform, next to the leaf spring.
Figure 6B:
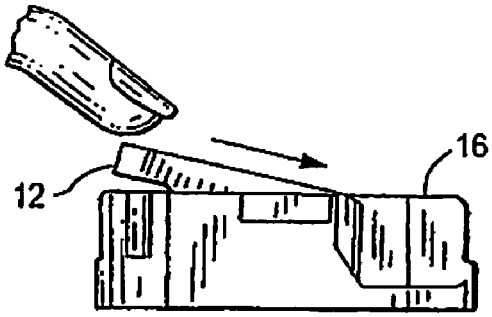
Figure 7A:
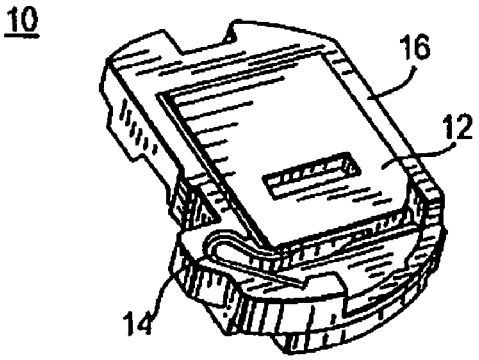
Figure 7B:
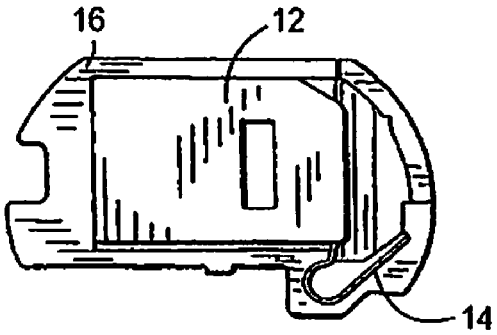

Leaf spring 14 is mounted in pocket 17 of platform 16 as is shown in the series of FIGS. 5*a*, 5*b*, 6*a*, 6*b*, 7*a*, and 7*b*. Accordingly, pocket 17 is configured to allow leaf spring 14 to rest in platform 16 and to hold slider 12 in place in a first position wherein the slider aperture 15 is misaligned with either aperture 11 of the platform 16. Specifically, leaf spring 14 is driven into pocket 17 using an appropriate tool 18 as shown in FIG. 5*a*. FIG. 5*b* displays the top view of the insertion of the leaf spring 14 into the platform using the tool 18. It should be noted that leaf spring 14 can be manually or mechanically placed into the platform sub-assembly. Likewise slider 12 is inserted either manually or mechanically as is shown in FIGS. 6*a* and 6*b*. FIGS. 3, 7*a*, and 7*b* show the completed platform sub-assembly from differing views, including isometric and top views.

Figure 4:
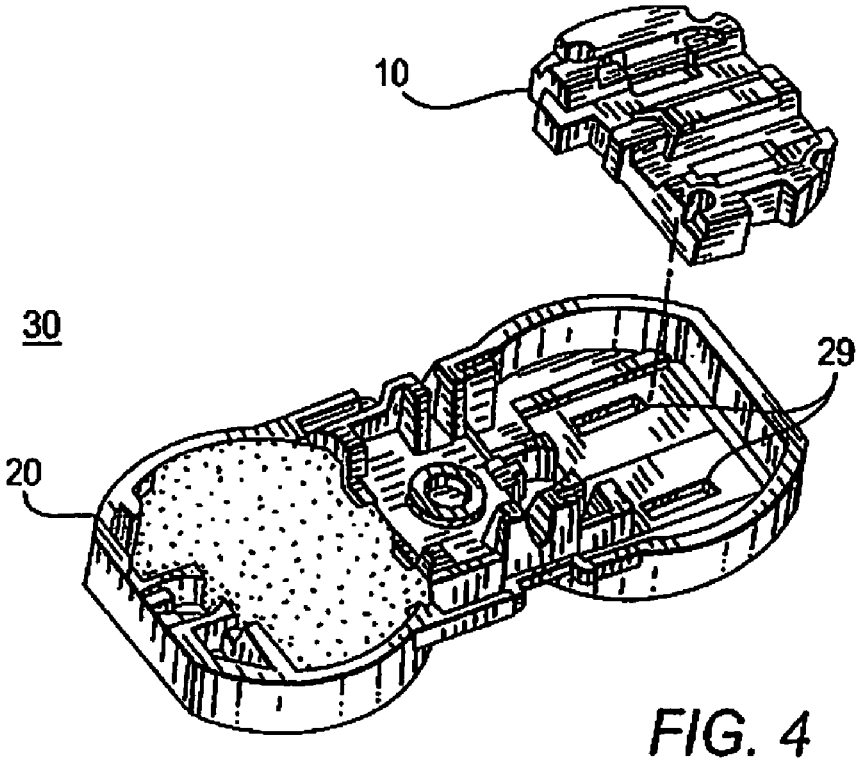
FIG. 4 shows the cover assembly in accordance with the present invention.

Referring to FIG. 4, the fully assembled cover assembly 30 includes at least one platform assembly 10 seated in the cover 20 behind the pair of apertures 29. In one embodiment the cover 20 and the platform sub-assembly 10 are held together by interference fit.

FIG. 8 displays cover assembly 30 aligned with the base assembly 36 to be combined to make tamper-resistant receptacle 40 shown in FIG. 9. Base assembly 36 includes all elements associated with a known electrical receptacle (i.e. strap, contacts, etc). The fully assembled tamper resistant receptacle 40 in accordance with the present invention is shown in FIG. 9. As shown, the outside of the 15 A, (125V) version of the tamper resistant receptacle in accordance with the present invention looks the same as an existing Leviton receptacle with the exception of the tamper-proof prong apertures. Accordingly, receptacle 40 offers the same features relative to the mounting strap.

The receptacle 40, shown in FIG. 10, is shown as a duplex three-prong electrical receptacle for handling 15 amp current applications. However, it should be understood that the receptacle can be a single two or three-prong electrical receptacle or a receptacle having capabilities greater than that of a duplex receptacle. In addition, the receptacle can have ground fault circuit interrupter (GFCI) capabilities. Moreover, the receptacle can be selected to handle other current capacities such as 20 amp, 30 amp, and 50 amp and other capacities.

Figure 12:
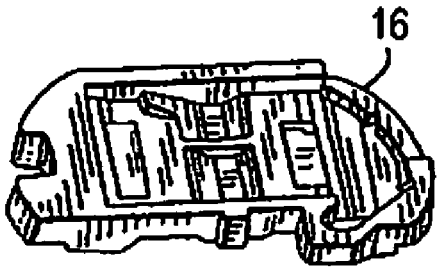
FIG. 12 displays the platform in accordance with one embodiment of the present invention.
Figure 13:
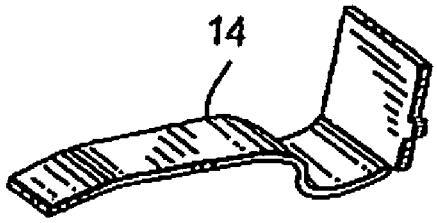
FIG. 13 shows the leaf spring in accordance with one embodiment of the present invention.

For another perspective, FIG. 12 provides a top view of platform 16. Furthermore, FIG. 13 provides a more detailed view of leaf spring 14. Moreover, FIGS. 14*a* and 14*b* displays front and back views of slider 12 for a more direct view of the ribs 13 formed on the back side of slider 12.

Figure 10A:
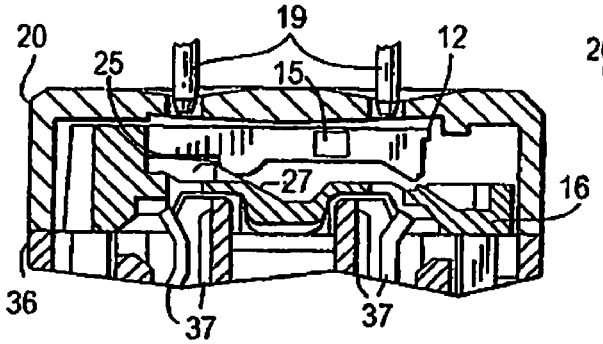
FIGS. 10*a* and 10*b* show the tamper resistant assembly when a pair of prongs from an electrical appliance are inserted into the pair of apertures in the cover at two respective depths.
Figure 10B:
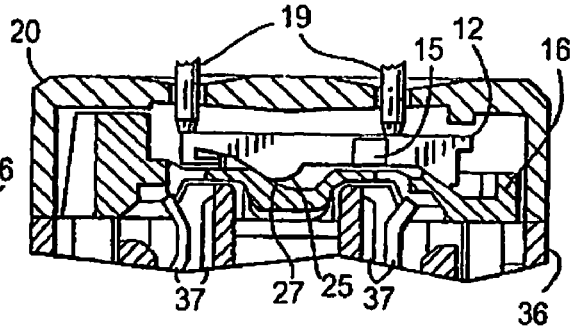

FIGS. 10*a* and 10*b*, illustrate what happens when an electrical plug having a pair of prongs is inserted in the apertures of the cover 20. As shown in FIG. 10*a*, just prior to having a pair of prongs inserted through the apertures in cover 20, the slider 12 blocks direct entry into the receptacle terminals formed by contacts 37. This first position for slider 12 is referred to as a misaligned position. As prongs 19 are inserted further, projection 25 of slider 12 slides into a second position down the slope 27 such that slider aperture 15 comes into alignment with one of the prongs 19. FIG. 10*b* illustrates the slider in an intermediary position, mid-way between the first position and the second position. This second position is referred to as an alignment position. As shown in FIG. 10*b*, projection 25 slides down slope 27 which brings slider aperture 15 closer in alignment with one of prongs 19. Once the slider 12 transitions completely to the second position, slider 12 aligns with the cover apertures, 39 and 41, to allow a first prong of prongs 19 to bypass on side of slider 12 and a second prong of prongs 19 to pass through slider aperture 15. As such, the width of the slider 12 is designed such that the other prong gains clearance straight through to the receptacle terminal when slider aperture 15 aligns with the aperture in cover 20. Thus, for this particular embodiment, the width between the slider aperture 15 and far end of the slider 12 should substantially equal the width that exists between the apertures in the cover 20. The first and second prongs 19 engage with receptacle terminals 37 to complete electrical contact with 40 once slider 12 has transitioned completely to the second position.

As shown in FIG. 6*a*, leaf spring 14 rests in pocket 17 juxtaposed to slider 12 in the first position. When the slider 12 transitions to the second position, the slider moves toward the pocket 17 and the leaf spring 14. As a result, the leaf spring 14 is compressed to the edge of the platform 16. Leaf spring 14 is designed to retract to its original position after being compressed similar to a conventional spring. Thus, when the prongs 19 are withdrawn, the leaf spring 14 springs slider 12 back to the first position.

Figure 11A:
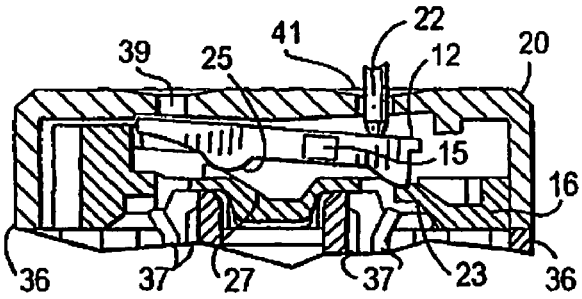
FIGS. 11*a* and 11*b* displays the tamper resistant assembly when a single object is used to probe apertures, 39 and 41, in the cover, respectively.
Figure 11B:
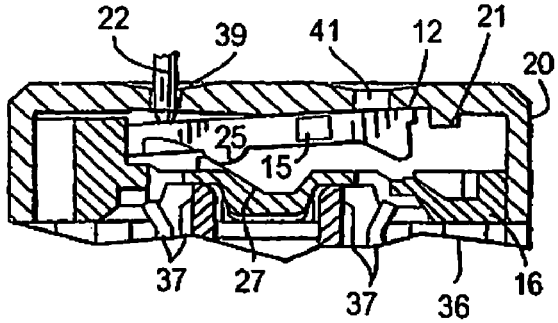

FIGS. 11*a* and 11*b*, display what happens when a simple straight insertion is attempted only through either the cover aperture, 41 or 39, respectively. In this case, when an object is inserted into either aperture 39 or 41, slider 12 remains confined in the misaligned position or the first position. Specifically, FIG. 1 la illustrates an object 22 being inserted in the aperture 41 of cover 20. As object 22 pushes slider 12 down towards the platform 16, the lower rib or projection 23 restricts the movement of the slider 12, such that slider 12 just tilts as oppose moving into the second position. Thereby, object 22 is prohibited from making contact with contacts 37 which form each receptacle terminal. In the alternative, FIG. 11*b* displays an object 22 inserted in the aperture 39 of cover 20. As shown, slider 12 is pushed downward towards platform 16 and is restricted from further movement down the slope 27 due to projection 21 formed in the cover 20. Similarly, as a result, slider 12 is disabled from transitioning to the second position. Thus, object 22 which probes the electrical receptacle 40 unsuccessfully makes contact with the accessible power of contacts 37 which form the receptacle terminal.

It should be noted that while most tamper resistant receptacles require a sloped surface to be engaged by the plug prong in order to obtain a lateral move, this mechanism incorporates a flat surface (i.e. the top surface of slider 12) instead for the prongs to push on in combination with a sloped surface in the interior surface of the platform 16 that causes the slider to move sideways as it is being pushed by prongs 19.

Figure 15:
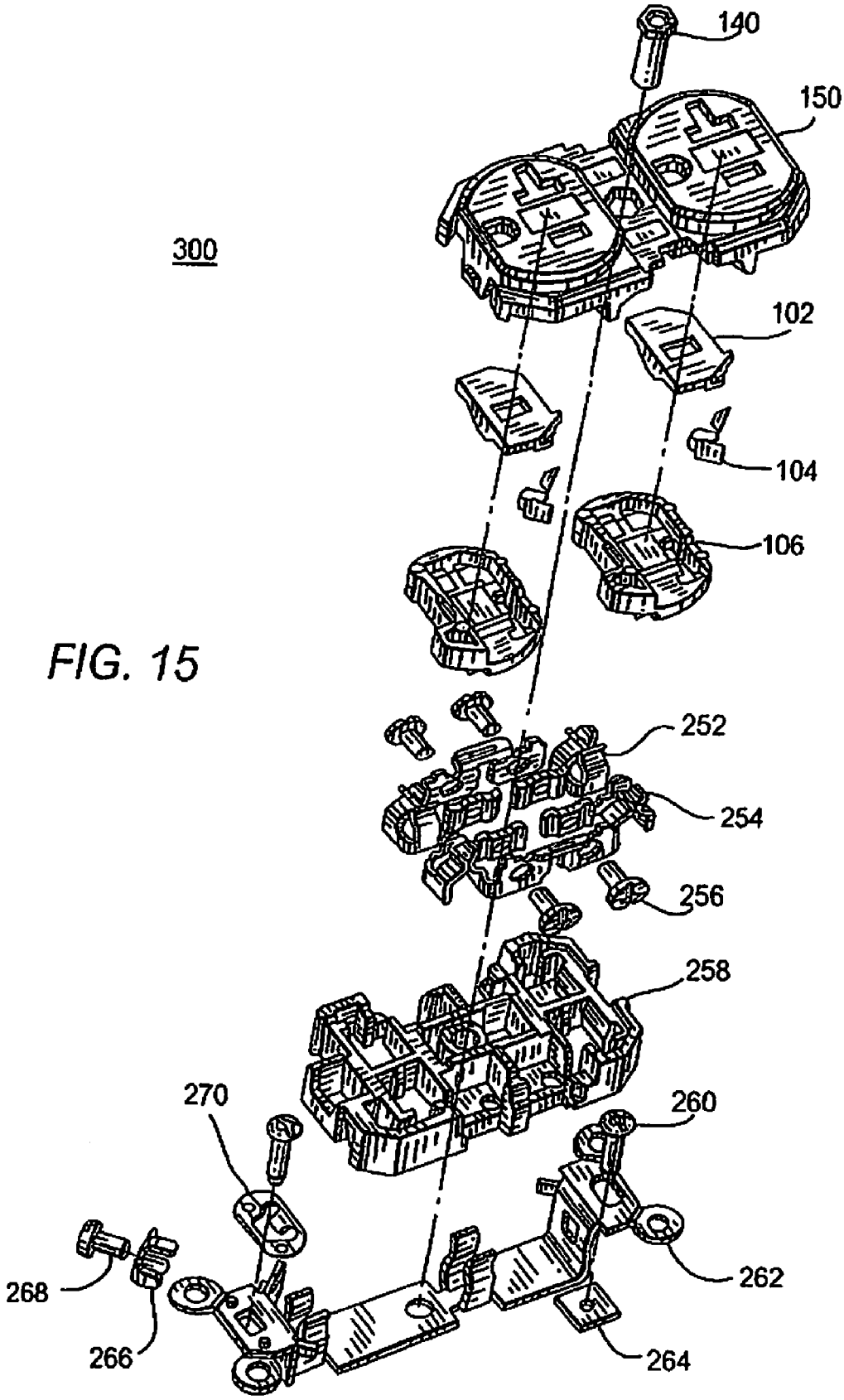
FIG. 15 shows an exploded view of the 20 ampere embodiment of the tamper resistant assembly in accordance with the present invention.

FIGS. 15-27 depict the component assemblies for a second embodiment of the tamper-resistant receptacle 300 in accordance with the present invention. The receptacle 300, as shown in FIG. 15, is a duplex three-prong electrical receptacle for handling 20 amp current applications. However, it should be understood that the receptacle can be a single two or three-prong electrical receptacle or a receptacle other than that of a duplex receptacle. In addition, the receptacle can have ground fault circuit interrupter (GFCI) capabilities. The receptacle also can be selected to handle other current capacities such as 30 amp, 50 amp, and other capacities.

FIG. 15 shows an exploded view of the 20 ampere embodiment of the tamper resistant electrical receptacle in accordance with the present invention. From the top of FIG. 15, cover 150 sits on top of platform sub-assembly 100 including platform 106, leaf spring 104 and slider 102. Terminal screws 256 connect the contacts 254 and twist-on wire connector 252 together within base 258. Screws 260 mounts strap 262 onto the base 258 using washers 264. Ground screw 268 secures ground clamp 266 and ground clip 270 to strap 262.

Figure 16A:
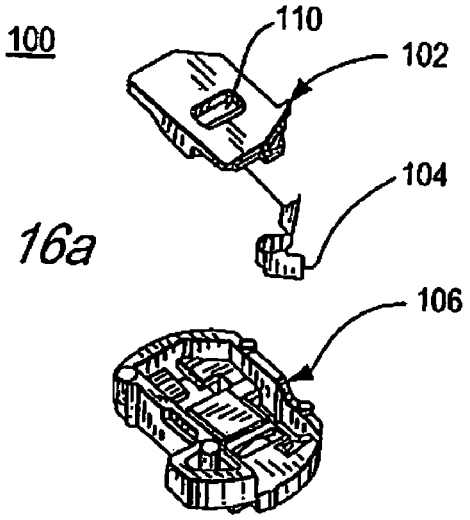
FIG. 16*a* illustrates an exploded view of a 20 ampere embodiment of the platform sub-assembly in accordance with the present invention.

In particular, and focusing upon the platform sub-assembly 100, FIG. 16*a* illustrates an exploded view of the platform sub-assembly 100 which includes a slider 102, a leaf spring 104, and a platform 106. Slider 102 includes at least one rib 120 displayed in FIGS. 22*a*, 22*b*, 24*a* and 24*b*. Similar to the previously described embodiment 40, it is noted that rib 120 may be one or more than one projections (not shown). Slider 102 includes a slider aperture 110 for alignment with the aperture of cover 150 which is explained in detail hereinafter. Leaf spring 104 is mounted in the pocket 107 of platform 106 as is shown in the series of FIGS. 18*a*, 18*b*, 19*a*, 19*b*, 20*a*, and 20*b*. FIGS. 23*a* and 23*b*, front and back views of leaf spring 104.

Figure 16B:
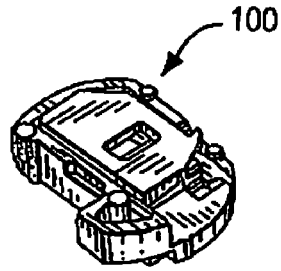
FIGS. 16*b*, 20*a* and 20*b* display the platform sub-assembly completely assembled in accordance with the present invention.
Figure 18A:
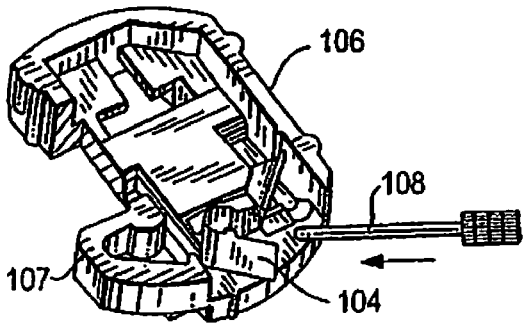
FIGS. 18*a* and 18*b* display two views of the leaf spring placement by a suitable tool into the platform in accordance with the present invention.
Figure 18B:
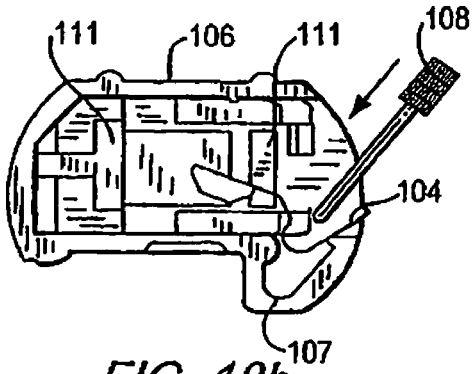
Figure 19A:
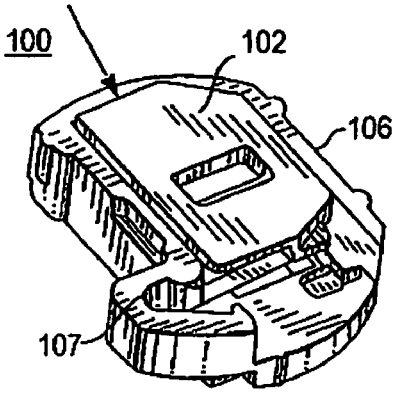
FIGS. 19*a* and 19*b* illustrate the placement of the slider into the platform, next to the leaf spring.
Figure 19B:
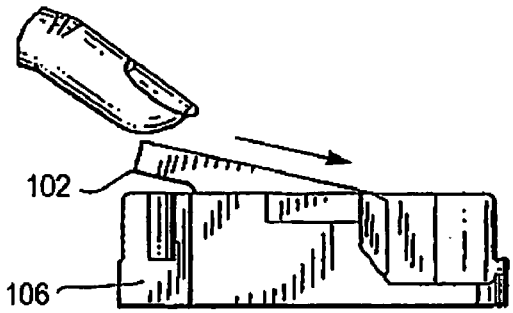
Figure 20A:
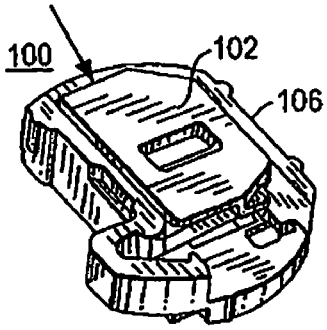
Figure 20B:
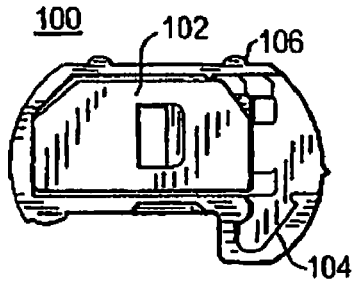

Accordingly, leaf spring 104 rests in the pocket 107 of platform 106 to bias slider 102 in place in a first position where the slider aperture 110 is misaligned with either aperture 111 of the platform 106. Specifically, leaf spring 104 is driven into pocket 107 using an appropriate tool 108 as shown in FIG. 18*a*. FIG. 18*b* displays the top view of the insertion of the leaf spring 104 into the platform using the tool 108. Although FIG. 18*a* refers to the platform assembly being manually assembled, it should be recognized by those skilled in the art that leaf spring 104 may be manually or mechanically inserted. FIGS. 19*a* and 19*b* show the platform sub-assembly being assembled by hand, wherein the slider is pushed into the slot within the platform juxtaposed to the leaf spring which holds the slider in place. The fully assembled sub-assembly 100 is shown in FIGS. 16*b*, 20*a*, and 20*b* includes the platform 106, leaf spring 104, and slider 102. These are placed in the cover assembly 200 as shown in FIG. 17.

Figure 17:
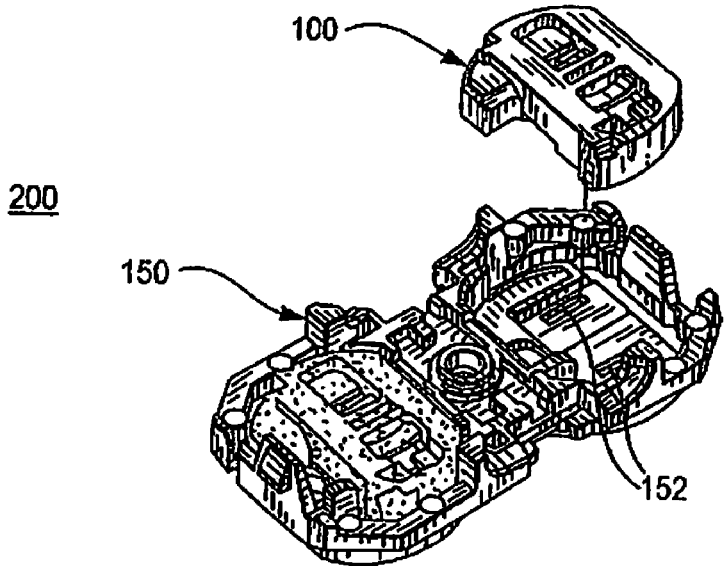
FIG. 17 shows the cover assembly in accordance with the present invention.
Figure 26:
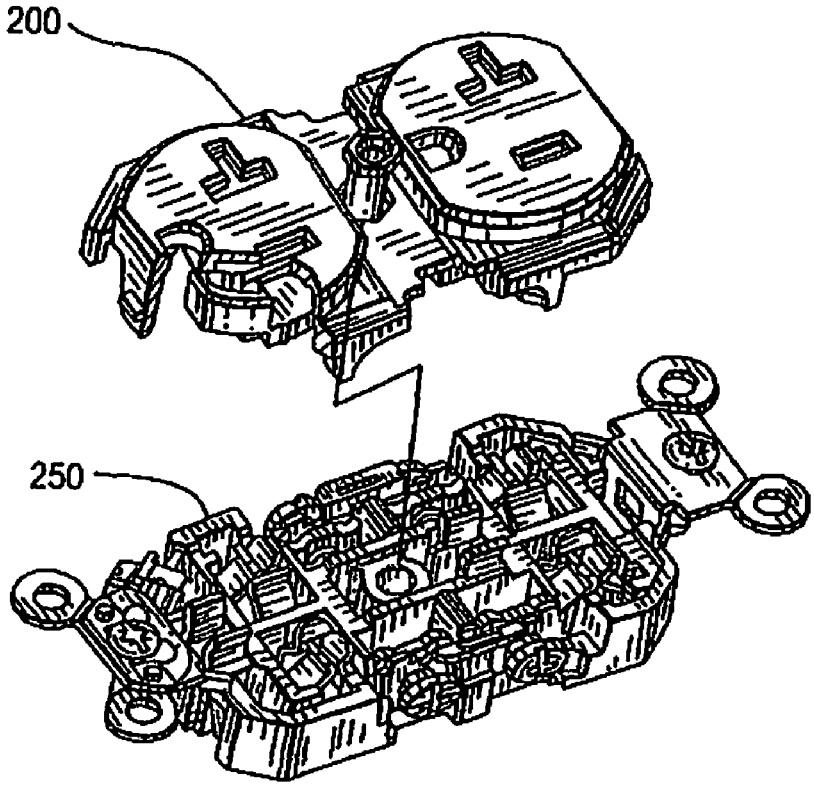
FIG. 26 illustrates an exploded view of the base and cover assembly in accordance with the present invention.
Figure 27:
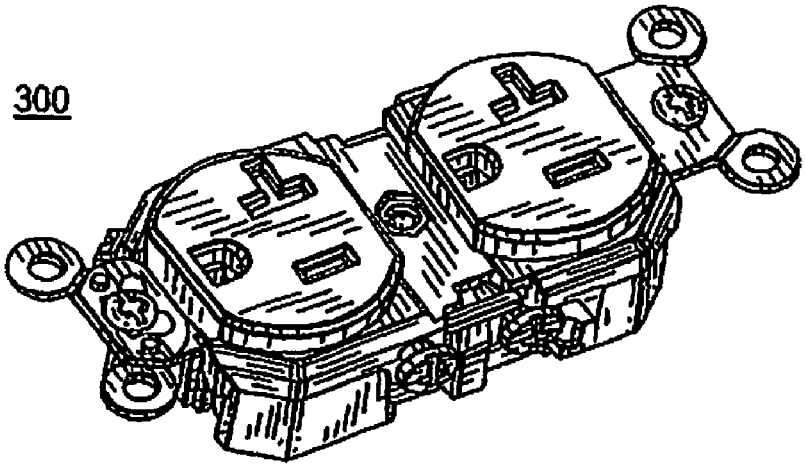
FIG. 27 displays the tamper resistant assembly in accordance with the present invention.

Referring to FIG. 17, the fully assembled cover assembly 200 includes at least one platform assembly 100 seated in the cover 150 behind the pair of apertures 152. In one embodiment the cover 150 and the platform sub-assembly 100 are held together by interference fit. The resulting cover assembly 200 is attached to the base assembly 250 as shown in FIGS. 26 and 27 to form the tamper resistant electrical receptacle 300. Specifically, FIG. 26 displays cover assembly 200 aligned with the base assembly 250 to be combined to make tamper-resistant receptacle 300. Base assembly 250 includes all elements associated with a known electrical receptacle (i.e. strap, contacts, etc). The fully assembled tamper resistant receptacle 300 in accordance with the present invention is shown in FIG. 27. The outside of the 20 A, (125V) version of the tamper resistant receptacle in accordance with the present invention looks the same as an existing Leviton receptacle with the exception of the tapered blade slots. The tamper-resistant receptacle offers the same features of the known receptacle including but not limited to those associated with the wrap around mounting strap. The marking on the face of the tamper-resistant receptacle helps to identify and distinguish it from the known electrical receptacle.

Figure 21A:
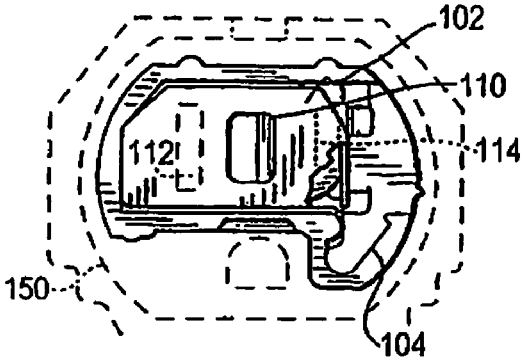
FIGS. 21*a* and 21*b* show the tamper resistant assembly prior to and after the insertion of a pair of prongs from an electrical appliance into the pair of apertures in the cover.
Figure 22A:
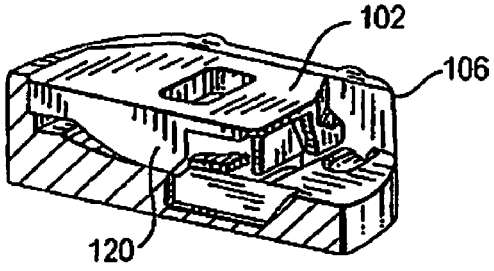
FIGS. 22*a* and 22*b* display another view of the tamper resistant assembly prior to and after the insertion of a pair of prongs from an electrical appliance into the pair of apertures in the cover.
Figure 23A:
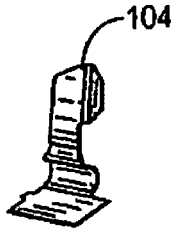
FIGS. 23*a* and 23*b* illustrate the front and back side of the leaf spring in accordance with one embodiment of the present invention.
Figure 23B:
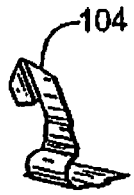
Figure 24A:
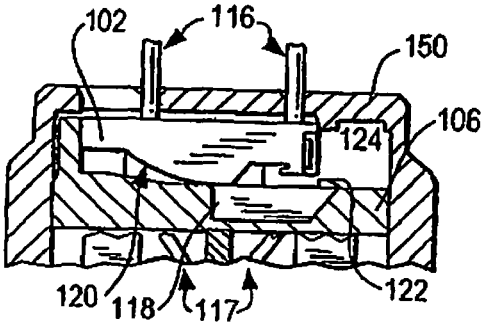
FIGS. 24*a* and 24*b* show the tamper resistant assembly when a pair of prongs from an electrical appliance are inserted into the pair of apertures in the cover at two respective depths.

In operation, slider 102 is initially in a first position where the slider blocks each aperture, 112 and 114, in the cover 150 as shown in FIGS. 21*a* and 22*a*. As shown, leaf spring 104 engages the slider 102 in the first position wherein the slider aperture 110 is misaligned with the aperture, 112 or 114, in the cover 150. As shown in FIG. 24*a*, rib 120 of slider 102 comes in contact with the cavity 118 of platform 106 allowing the slider 102 to move laterally. Leaf spring 104 biases slider 102 and retains the slider 102 to one side in a position where the slider aperture 110 is misaligned with either aperture, 112 or 114, in the cover 150. Similar to the previous embodiment as shown in FIG. 14*b*, it is noted that rib 120 may be more than one rib on the bottom slider 102.

Figure 21B:
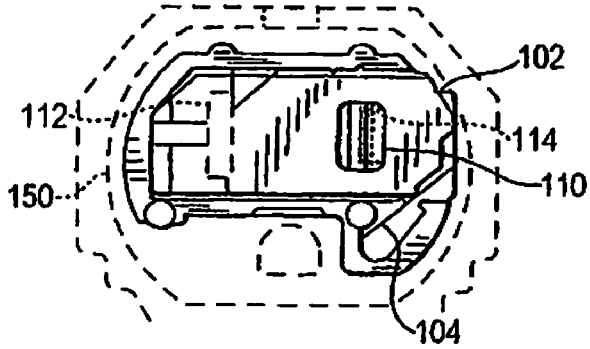
Figure 22B:
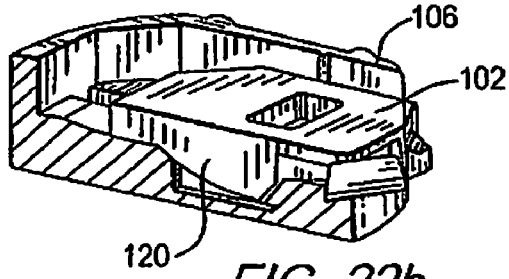
Figure 24B:
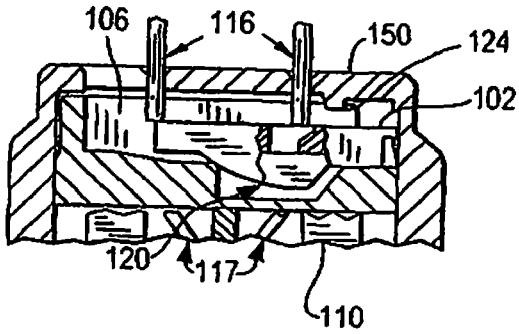

Further, as shown in FIG. 24*a* when a conventional electrical plug having a pair of prongs are inserted into the cover 150 of receptacle 300 through the apertures in cover 150, the slider blocks entry into the receptacle terminals formed by contacts 117. As the prongs 116 are inserted further, the projection 120 of slider 102 slides into a second position down into cavity 118 such that slider aperture 110 comes into alignment with one of the prongs 116. FIG. 24*b* illustrates the slider 102 in an intermediary position, mid-way between the first position and the second position. As shown in FIG. 24*b*, projection 120 slides down into chamber 118 which brings slider aperture 110 closer in alignment with one prong 116. Once the slider 102 transitions completely to the second position, slider 102 aligns with the cover apertures, 112 and 114, to allow a first prong of prongs 116 to bypass on side of slider 102 and a second prong of prongs 116 to pass through slider aperture 110. As such, the width of the slider 102 is designed such that the other prong gains clearance straight through to the receptacle terminal when slider aperture 110 aligns with the aperture in cover 150. When the slider 102 is in the alignment position, the prongs are allowed to enter through cover assembly 200 so as to engage the contacts 117 that form the receptacle terminals for the receptacle 300. FIGS. 21*b* and 22*b*, illustrate the alignment position wherein the slider 102 has shifted into the second position providing clearance for both apertures, 112 and 114, in cover 150. In this position, slider 102 presses against the leaf spring 104 and is held in the alignment position by the prongs 116 which are inserted therein. When the prongs 116 are removed, the biasing force of the leaf spring 104 urges slider 102 back into the misaligned position as shown in FIGS. 21*a* and 22*a*. FIGS. 22*a* and 22*b*, depict the slider 102 in the first and second positions similar to FIGS. 21*a* and 21*b*, but from a different angle.

Figure 25A:
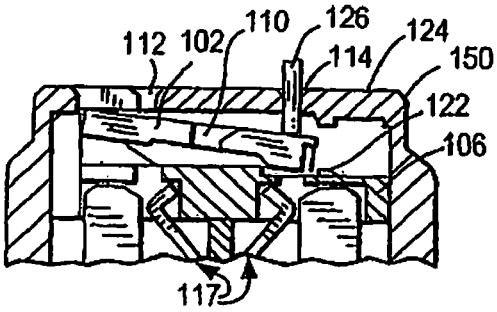
FIGS. 25*a* and 25*b* display the tamper resistant assembly when a single object is used to probe the apertures; 112 and 114: in the cover, respectively.
Figure 25B:
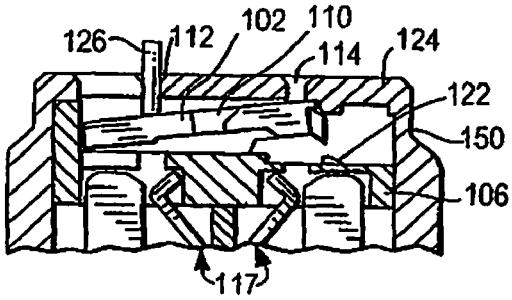

Specifically, FIGS. 24*a* and 24*b*, differ from FIGS. 25*a* and 25*b*, in that the viewing prospective of the diagram for FIGS. 24*a* and 24*b*, shows a cross-section view of FIG. 27 taken along Section line A-A where the cut extends through receptacle 300 at the point through either rib 120. FIGS. 25*a* and 25*b*, show a cross-section view of FIG. 27 taken along Section line B-B which represents a cut through the space that lies between ribs 120. Thus, rib 120 is not shown in FIGS. 25*a* and 25*b* since the cut is in the section between the two part rib 120 (reference FIG. 14*b*).

In the case where an object is inserted into either aperture, the slider 102 remains confined in the misaligned position or the first position. FIGS. 25*a* and 25*b*, display what happens when an insertion is attempted in either aperture 112 and 114, respectively. As depicted in FIG. 25*a* when an object 126 is inserted in the aperture 114 of cover 150, slider 102 is pushed down towards the platform and is confined by a lower rib or projection 122. Thus, even if a determined attempt is made to force slider 102 in the aperture 114 of the cover 150, projection 122 blocks the slider 102 from movement out of the first position where the slider aperture 110 is misaligned with the aperture in the cover 150. Object 126 is thereby prohibited from making contact with the contacts 117 that form the receptacle terminal.

FIG. 25*b* depicts an object 126 being inserted in aperture 112 of cover 150. As depicted therein, slider 102 pushes downward towards the platform 106 and only limited movement is permitted before the right edge (as shown) of slider 102 is blocked from further movement by projection or rib 124. Thus, projection 124 blocks slider 102 from movement out of the first position, wherein slider aperture 110 is misaligned with the aperture in the cover 150.

Note that while most tamper resistant concepts require a sloped surface to be engaged by the plug blade in order to obtain a lateral move, the tamper resistant electrical receptacle 100 in accordance with the present invention includes a flat surfaced slider 102 for the blades to push on. A sloped surface 120 in the interior surface of the slider 102 causes the slider 102 to move laterally into cavity 118 defined by platform 106.

Figure 28A:
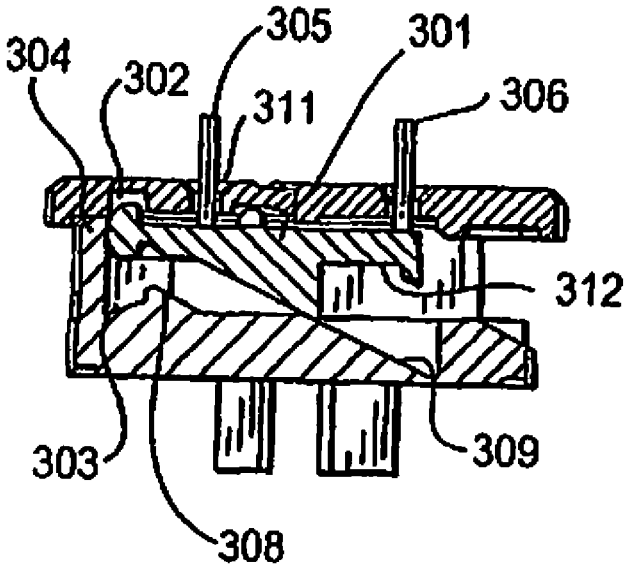
FIGS. 28*a* and 28*b* depict a tamper resistant assembly in accordance with the present invention prior to and after insertion of a pair of prongs from an electrical appliance.
Figure 28B:
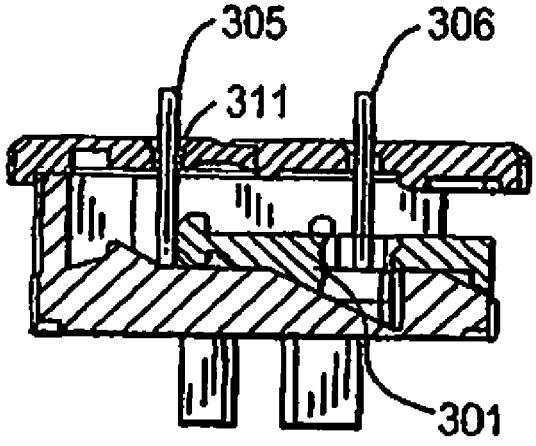

FIGS. 28 and 29 discloses another embodiment of the present invention comprising a shutter having a different geometry than those of the embodiments previously described herein. As is depicted in FIG. 28*a*, a receptacle 300 in accordance with this embodiment comprises a shutter 301 shaped such that a locking end 304 is adapted to nestle in pocket 302, engage tab 308 or slide down ramp 309 depending on the type of force applied to the shutter. As shown in FIG. 28*a*, when prongs 305 and 306 are inserted into apertures 310 and 311 respectively an evenly distributed force is placed on shutter 301 thereby causing shutter 301 move from a first position as shown in FIG. 28A, to a second position as shown in FIG. 28*b*.

Figure 29A:
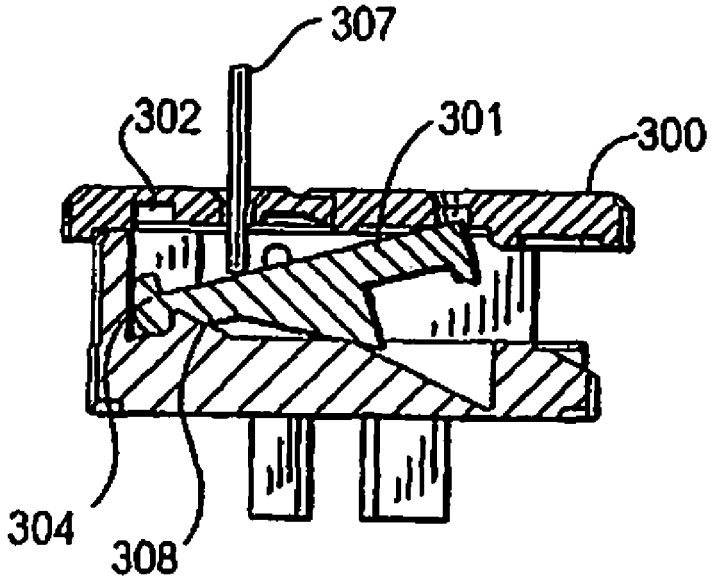
FIGS. 29*a* and 29*b* depict a tamper resistant assembly in accordance with the present invention when a single object is used to probe apertures in the assembly.
Figure 29B:
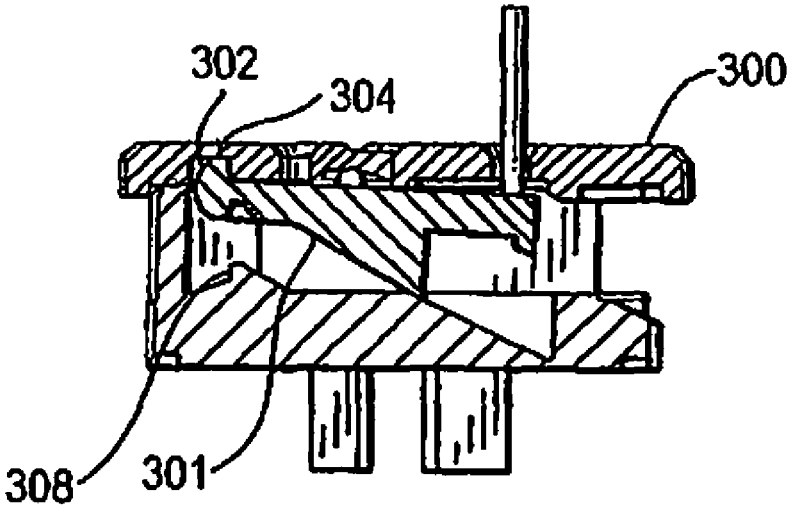

With a balanced force applied to the shutter 301, the shutter 301 slides down ramp 309 thereby permitting prong 305 to slide past locking end 304 and allowing prong 306 to penetrate shutter aperture 312. This condition is depicted in FIG. 28*b*. In the instance where a projection is placed in only one of the apertures of the receptacle 300, the shutter 301 is thereby subjected to an unbalanced force and prevented from translating along ramp 309 by locking end 304. This condition is depicted in FIGS. 29*a* and 29*b*. FIG. 29*a* depicts the resulting condition when a projections placed in the left aperture of receptacle 300. When this occurs, shutter 301 is caused to pivot such that locking end 304 engages tab 308, thereby preventing any translation of shutter 301 from its initial position. FIG. 29*b* depicts the case where a single projection is placed in the right aperture of receptacle 300. When this occurs, shutter 301 is again caused to pivot. However in this instance locking end 304 is made to fully nestle in pocket 302, thereby causing locking end 304 to engage the body of the receptacle 300 and preventing translation of shutter 301. This embodiment permits the shutter 301 to translate a distance greater than that afforded by the other embodiments of the invention. In this embodiment the preferred distance is 0.375" whereas in the prior embodiments the preferred distance is 0.125".

Those of skill in the art will recognize that the physical location of the elements illustrated in FIGS. 1 and 15 can be moved or relocated while retaining the function described above. For example, the location and shape of the leaf spring may be adjusted or reversed and the function of the tamper resistant assembly in accordance with the present invention will remain.

Turning now to FIGS. 30-42C, a platform subassembly, for a receptacle 40 (see FIG. 1), according to another embodiment of the present disclosure, is generally designated as 410. Platform subassembly 410 is substantially similar to platform subassembly 10 and thus will only be discussed in detail herein to the extent necessary to identify differences in construction and operation thereof.

Figure 30:
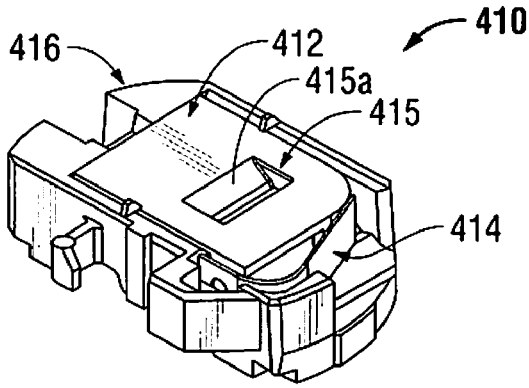
FIG. 30 is a perspective view of a platform subassembly according to another embodiment of the present disclosure, for use with a 15 Amp receptacle.
Figure 31:
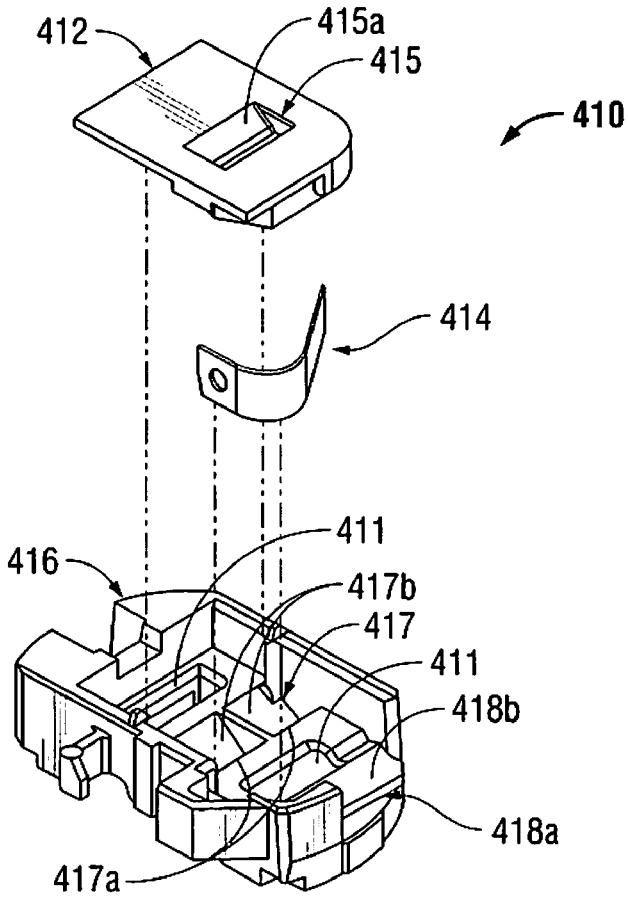
FIG. 31 is an exploded, perspective view of the platform subassembly of FIG. 30.
Figure 32:
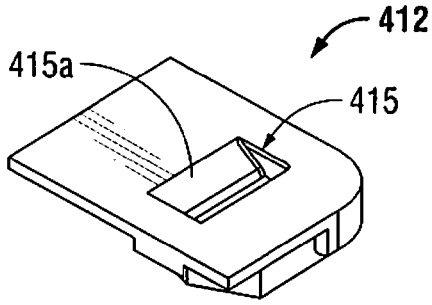
FIG. 32 is a perspective view of a slider of the platform subassembly of FIGS. 30 and 31.
Figure 33:
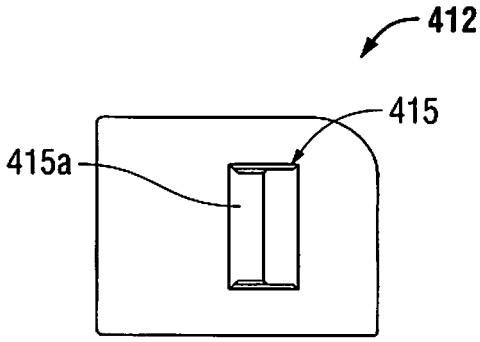
FIG. 33 is a top, plan view of the slider of FIG. 32.

As seen in FIGS. 30 and 31, platform subassembly 410 includes a platform 416 defining a pocket 417, a slider 412 at least partially slidably disposed within pocket 417 of platform 416, and a biasing member 414 interposed between platform 416 and slider 412 in such a manner so as to bias slider 412 to a home or blocking position within pocket 417 of platform 416.

Figure 34:
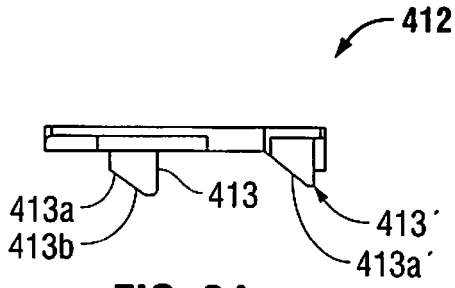
FIG. 34 is a right, side elevational view of the slider of FIG. 32.
Figure 35:
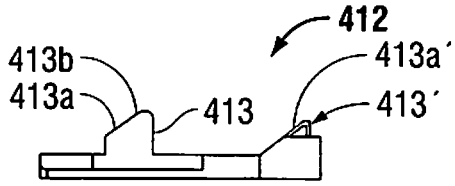
FIG. 35 is a left, side elevational view of the slider of FIG. 32.
Figure 36:
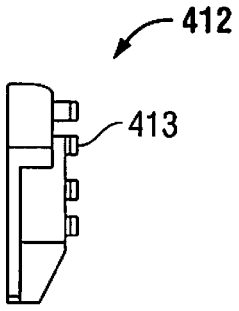
FIG. 36 is a front, elevational view of the slider of FIG. 32.
Figure 37:
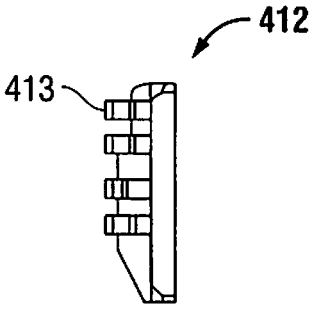
FIG. 37 is a rear, elevational view of the slider of FIG. 32.
Figure 38:
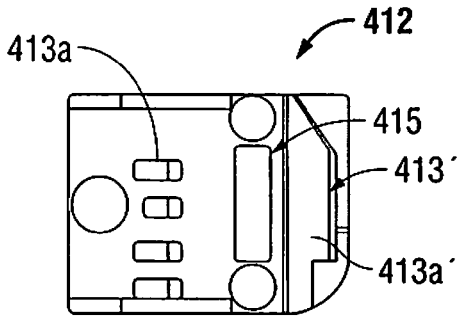
FIG. 38 is a bottom, plan view of the slider of FIG. 32.
Figure 39:
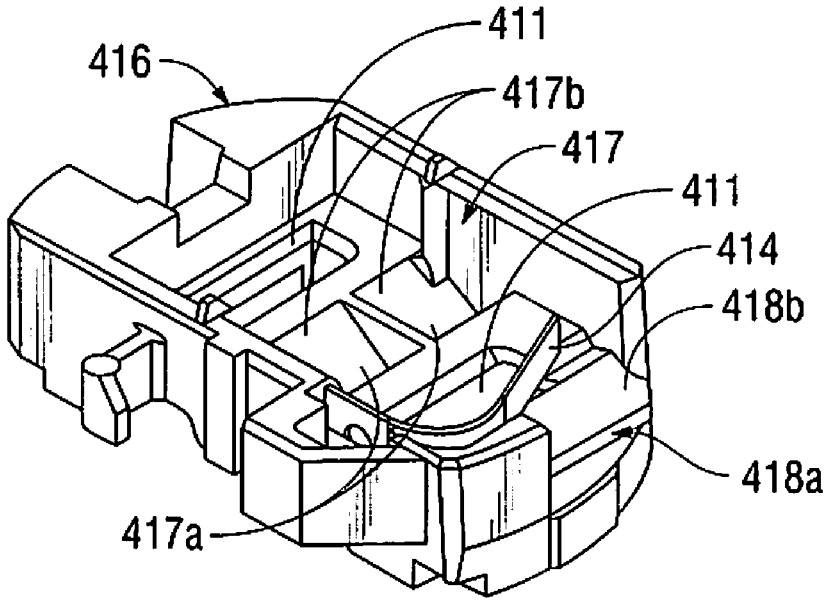
FIG. 39 is a perspective view of a platform of the platform subassembly of FIGS. 30 and 31.
Figure 40:
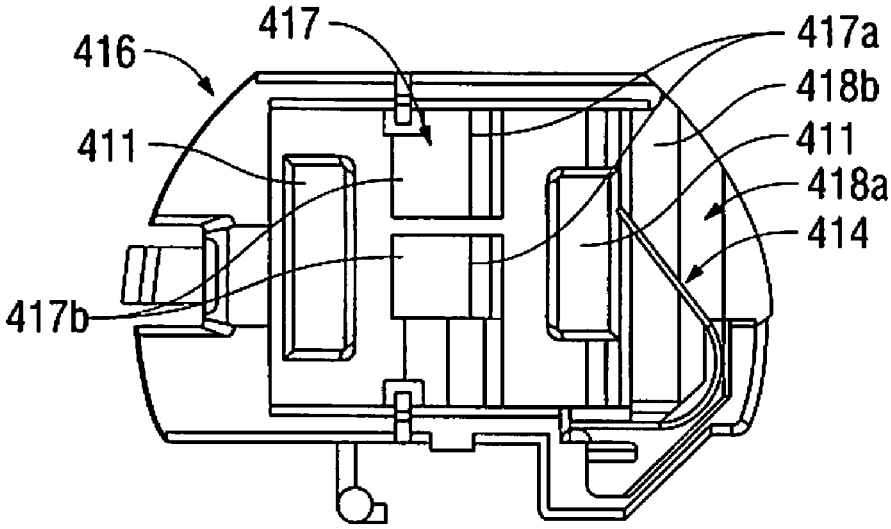
FIG. 40 is a top, plan view of the platform of FIG. 39.

As seen in FIGS. 34 and 35, slider 412 includes at least one rib 413 projecting from a bottom surface thereof. Each rib 413 defines an angled, tapered or sloped proximal surface 413*a* spaced a distance from the bottom surface of slider 412. Each angled surface 413*a* of ribs 413 terminates in a rounded distal end 413*b*. Distal end 413*b* of each rib 413 has been rounded in order to reduce any "picking" effects of slider 412 against platform 416 and to improve the performance thereof.

As seen in FIGS. 34 and 35, slider 412 further includes a projection 413', axially spaced from ribs 413, projecting from a bottom surface thereof. Projection 413' defines an angled, tapered or sloped proximal surface 413*a*' that is oriented in a direction substantially parallel to angled surface 413*a* of ribs 413.

As seen in FIGS. 30-33 and 38, slider 412 further includes a slider aperture 415 formed therein to enable one prong to be inserted therethrough to make contact with the receptacle terminals in the base of the tamper resistant receptacle 40. As mentioned above, cover 20 of receptacle 40 may include at least one pair of apertures. As such, slider aperture 415 must align with at least one of the apertures from an aperture pair of cover 20 to enable a prong to pass through the slider aperture 415 to a receptacle terminal, as described above. As seen in FIGS. 30-33, slider aperture 415 includes a ramped rear end portion 415*a*.

As seen in FIGS. 30-33 and 38, platform 416 includes a pair of apertures 411 formed in a bottom surface of pocket 417. Pocket 417 defines at least one recess 417*a* therein, at a location interposed between the pair of apertures 411. Recess 417*a* of platform 416 is configured and dimensioned to selectively receive and accommodate ribs 413 of slider 412 therein. Each recess 417*a* defines an angled or sloped rear wall 417*b*, defining a camming surface for engagement and/or contact with angled surface 413*a* of ribs 413.

Pocket 417 may further define a second recess 418*a* at a location adjacent one of the pair of apertures 411, preferably on a side located furthest from sloped rear wall 417*b* of first recess 417*a*. Second recess 418*a* may also have an angled or sloped rear wall 418*b*, defining a camming surface for engagement and/or contact with angled surface 413*a*' of projection 413'.

Biasing member 414, in the form of a leaf spring, is mounted in cavity 417 of platform 416 in a manner so as to bias or hold slider 412 in place in a first position wherein aperture 415 of slider 412 is misaligned with either aperture 411 of platform 416.

Assembly of platform subassembly 410 is accomplished in a manner substantially similar to platform subassembly 10 and thus will not be described in further detail herein.

Figure 41A:
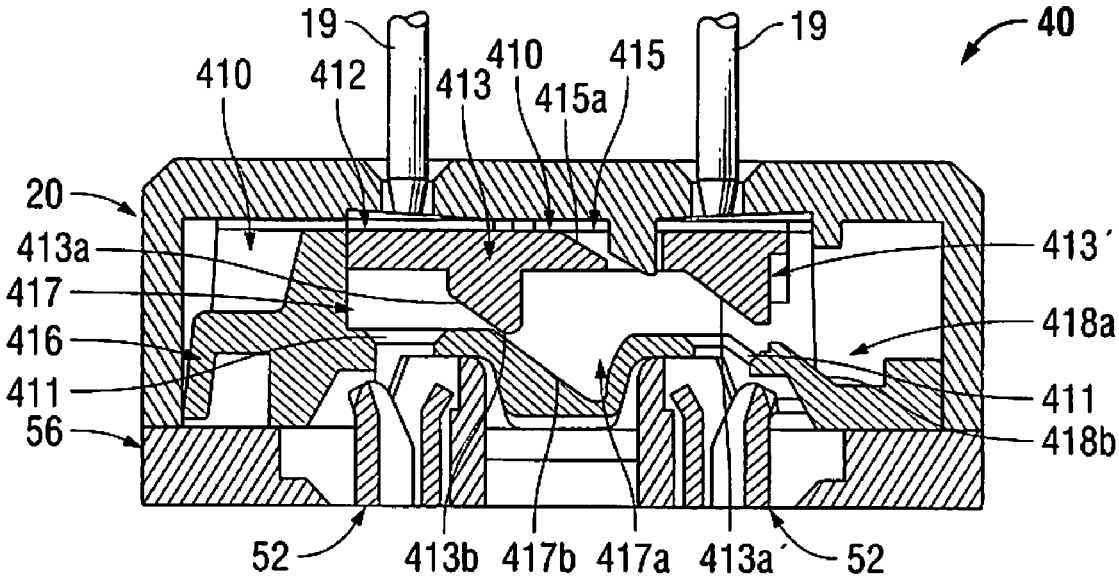
FIGS. 41A and 41B show the platform subassembly of FIGS. 30-40, when a pair of prongs from an electrical appliance are inserted into the pair of apertures in the cover at a common depth.
Figure 41B:
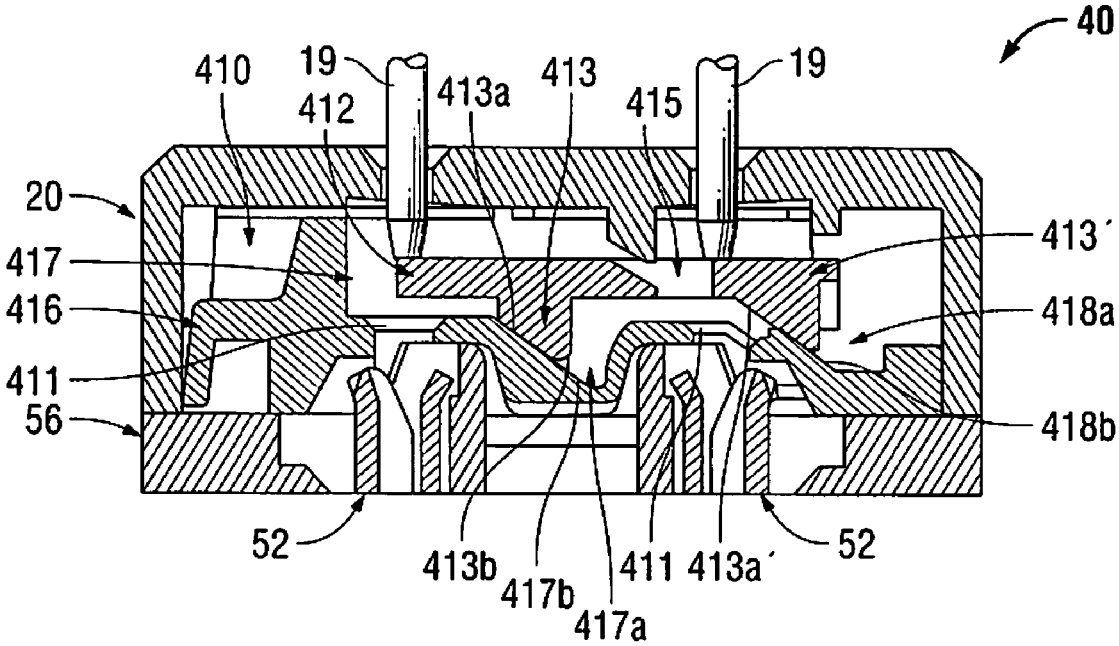

Turning now to FIGS. 41A and 41B, operation of platform subassembly 410 in a receptacle, upon insertion of an electrical plug in the receptacle 40, is shown and described. As seen in FIGS. 41A and 41B, platform subassembly 410 is housed within receptacle 40 at a location between cover 20 and base 56 (including contacts 52).

As shown in FIG. 41A, just prior to having a pair of prongs inserted through the apertures in cover 20, slider 412 blocks direct entry into the receptacle terminals 52. This first position for slider 412 is referred to as a misaligned position. As prongs 19 are inserted further, ribs 413 and projection 413' of slider 412 slide into a second position down respective slopes or camming surfaces 417*b*, 418*b* of platform 416 such that aperture 415 of slider 412 comes into alignment with one of the prongs 19.

As shown in FIG. 41B, slider 412 is illustrated in an intermediary position, mid-way between the first position and the second position (i.e., an alignment position). As shown in FIG. 41B, ribs 413 slide down slope 417*b* of recess 417*a* and projection 413' slides down slope 418*b* of recess 418*a* thereby bringing aperture 415 of slider 412 closer in alignment with one of prongs 19. Once slider 412 transitions completely to the second position, slider 412 aligns with the cover apertures to allow a first prong of prongs 19 to bypass along a side of slider 412 and a second prong of prongs 19 to pass through aperture 415 of slider 412.

As such, the width of slider 412 is designed such that the other prong gains clearance straight through to the receptacle terminal when aperture 415 of slider 412 aligns with the aperture in cover 20. Thus, for this embodiment, the width between aperture 415 of slider 412 and a far end of slider 412 should be substantially equal to the width that exists between the apertures in cover 20. The first and second prongs 19 engage with receptacle terminals 52 to complete electrical contact with 40 once slider 412 has transitioned completely to the second position.

As slider 412 is transitioning from the first position to the second position, slider 412 acts on biasing member 414 to thereby bias biasing member 414. Biasing member 414 is designed to retract to its original position after being biased similar to a conventional spring. Thus, when the prongs 19 are withdrawn, biasing member 414 springs slider 412 back to the first position.

As seen in FIGS. 41A and 41B, since each angled surface 413*a* of ribs 413 terminates in a rounded distal end 413*b*, "picking" of slider 412 against platform 416 has been reduced and operability or slidability as been improved.

Figure 42A:
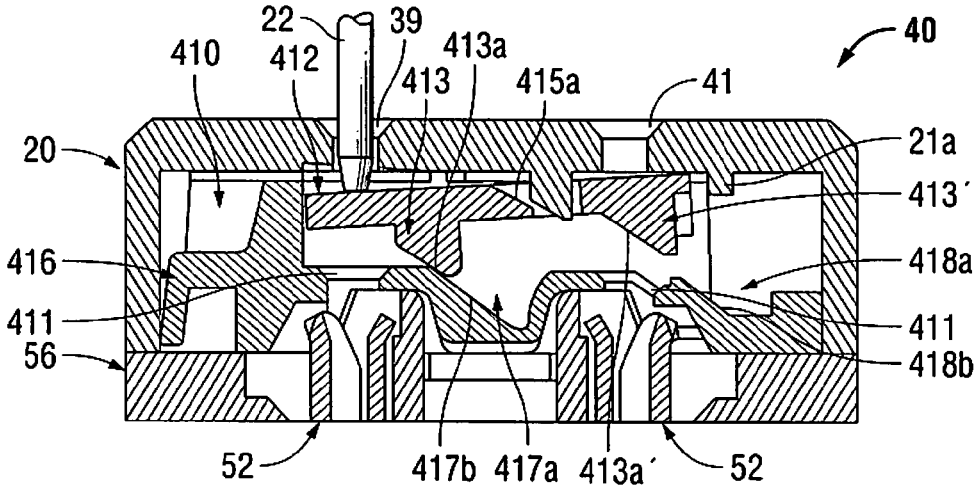
FIGS. 42A and 42B show the platform subassembly of FIGS. 30-40, when a single object is used to probe an aperture of the cover.
Figure 42B:
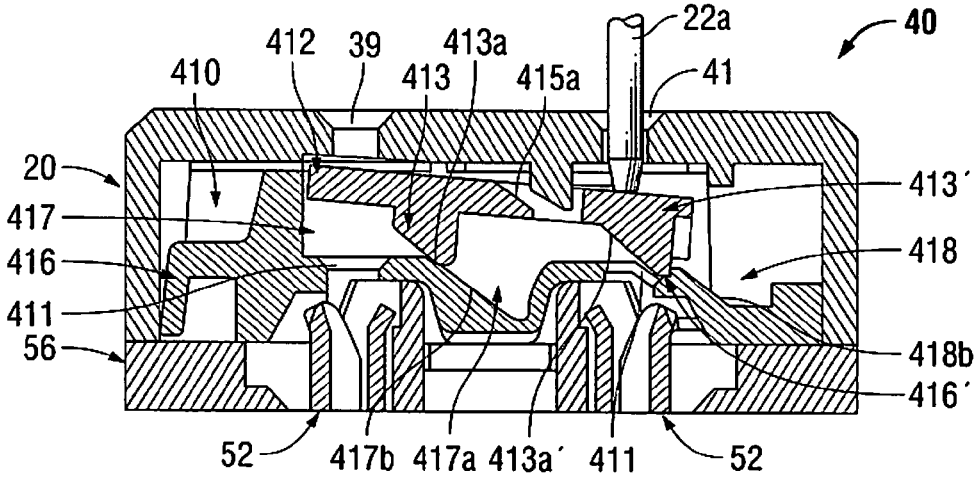

Turning now to FIGS. 42A-42B, there is illustrated what happens when a simple straight insertion is attempted only through one of the pair of cover apertures 39 or 41. In this case, when an object is inserted into either aperture 39 or 41, slider 412 remains confined in the misaligned position or the first position. Specifically, as seen in FIG. 42A, when an object 22 is inserted into aperture 39 of cover 20, object 22 pushes a proximal end of slider 412 down in the direction of platform 416 and restricts slider 412 from further movement down surface 417*b* of recess 417*a* of platform 416 due to the abutment of a front edge of slider 412 against a first projection 21*a* formed in cover 20. First projection 21*a* of cover 20 restricts the movement of slider 412, such that slider 412 just tilts or cants as opposed to moving to the second position. As a result, slider 412 is disabled from transitioning to the second position. Thus, object 22 which probes the electrical receptacle 40 fails to make contact with the accessible power of contacts 52 which form the receptacle terminal.

In the alternative, as seen in FIG. 42B, when an object 22*a* is inserted into aperture 41 of cover 20, object 22*a* pushes a distal end of slider 412 down in the direction of platform 416 and restricts slider 412 from further movement down surface 417*b* of recess 417*a* of platform 416 due to the abutment of an edge of projection 413' of slider 412 against a projection or ledge 416' formed in platform 416. Ledge 416' of platform 416 restricts the movement of slider 412, such that slider 412 just tilts or cants as opposed to moving to the second position. As a result, slider 412 is once again disabled from transitioning to the second position. Thereby, object 22*a* which probes the electrical receptacle 40 fails to make contact with the accessible power of contacts 52 which form the receptacle terminal.

Figure 42C:
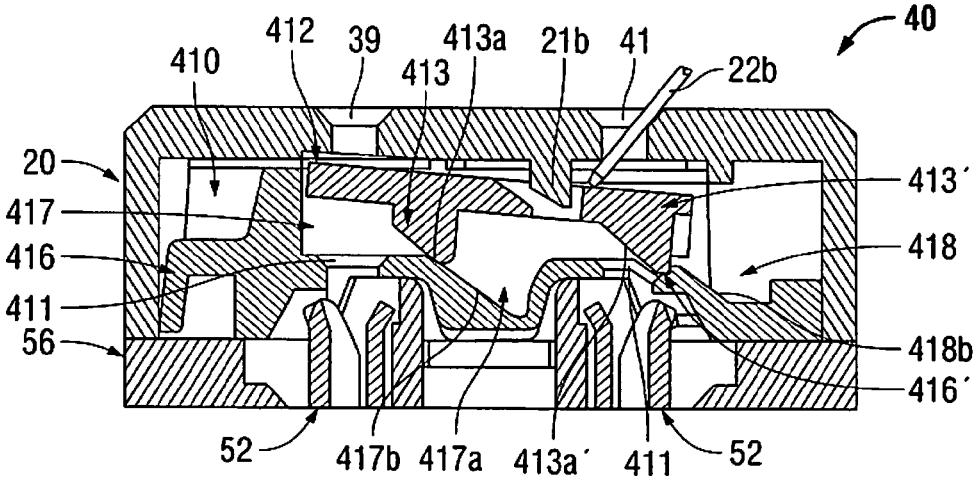
FIG. 42C shows the platform subassembly of FIGS. 30-40, when a single object is used to probe an aperture of the cover while being introduced at an angle.

Turning now to FIG. 42C, when an object 22*b* is inserted, at an angle, into aperture 41 of cover 20, object 22*b* will abut against and be blocked from complete penetration by a second wall or projection 21*b* extending from an inner surface thereof, at a location between apertures 39 and 41. Thereby, object 22*b* which probes the electrical receptacle 40, at an angle, fails to make contact with the accessible power of contacts 52 which form the receptacle terminal.

Turning now to FIGS. 43-50B, a platform subassembly for a 20 Amp receptacle 540, according to another embodiment of the present disclosure, is generally designated as 510. Platform subassembly 510 is substantially similar to platform subassembly 10 and thus will only be discussed in detail herein to the extent necessary to identify differences in construction and operation thereof.

Figure 43:
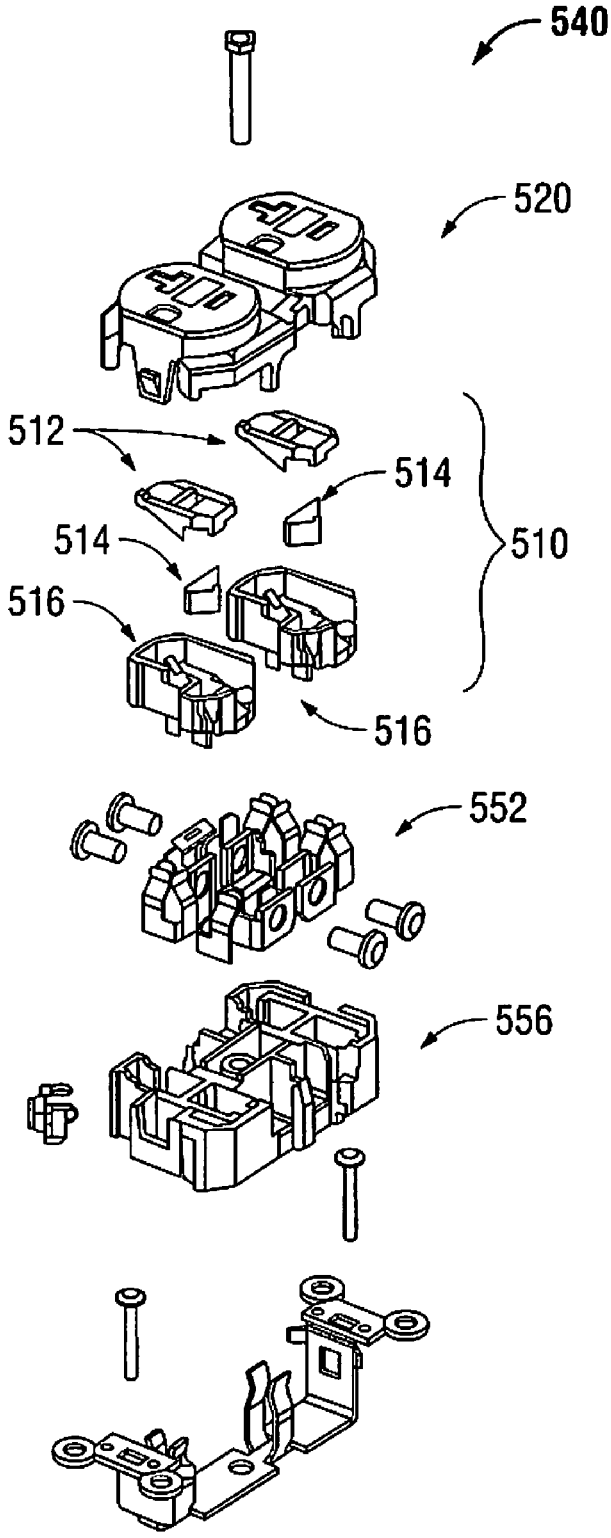
FIG. 43 is a perspective view, with parts separated, of a 20 Amp receptacle including a platform subassembly according to another embodiment of the present disclosure.
Figure 44:
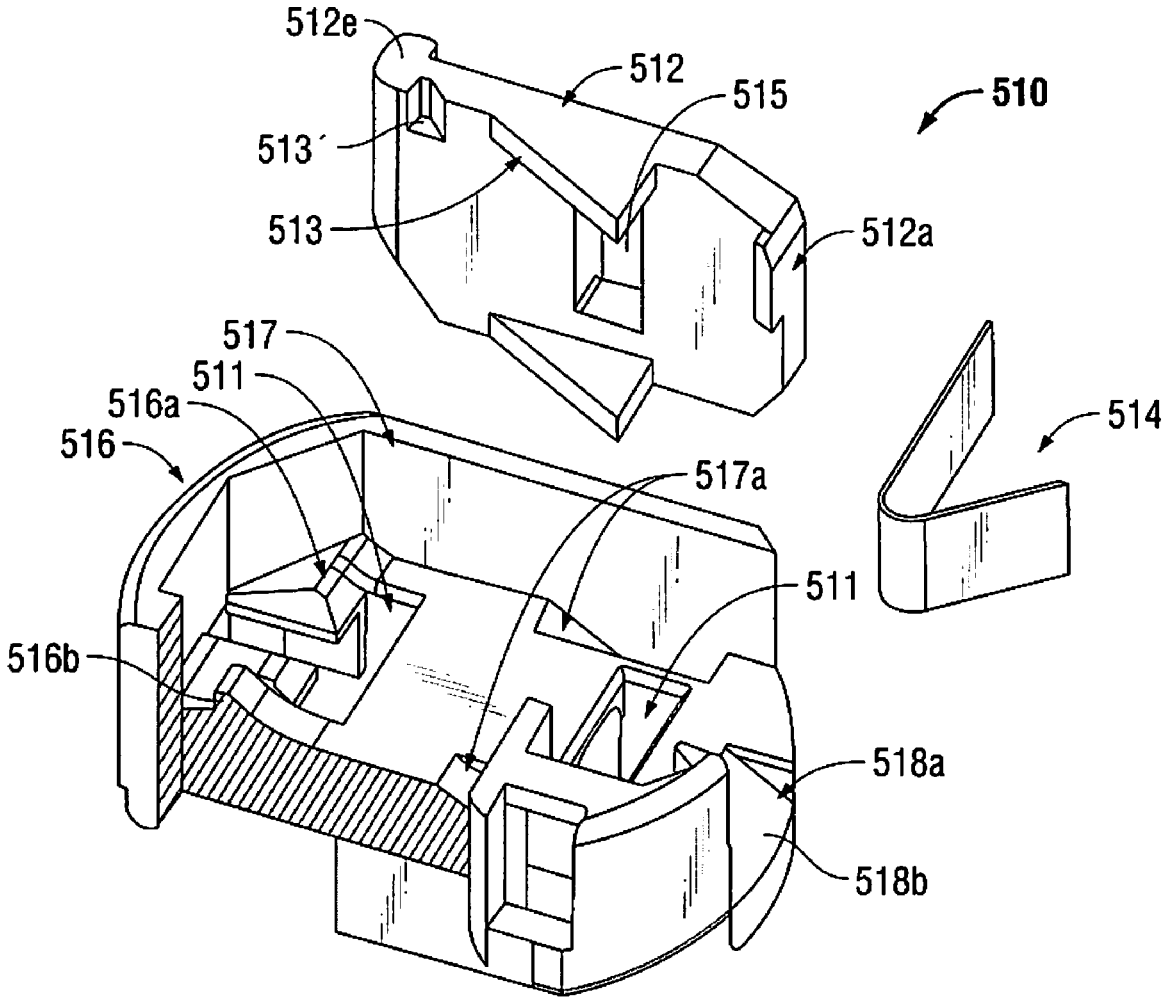
FIG. 44 is a perspective view, with parts separated, of the platform subassembly of FIG. 43.

As seen in FIGS. 43 and 44, platform subassembly 510 includes a platform 516 defining a pocket 517, a slider 512 at least partially slidably disposed within pocket 517 of platform 516, and a biasing member 514 interposed between platform 516 and slider 512 in such a manner so as to bias slider 512 to a home or blocking position within pocket 517 of platform 516.

Figure 45:
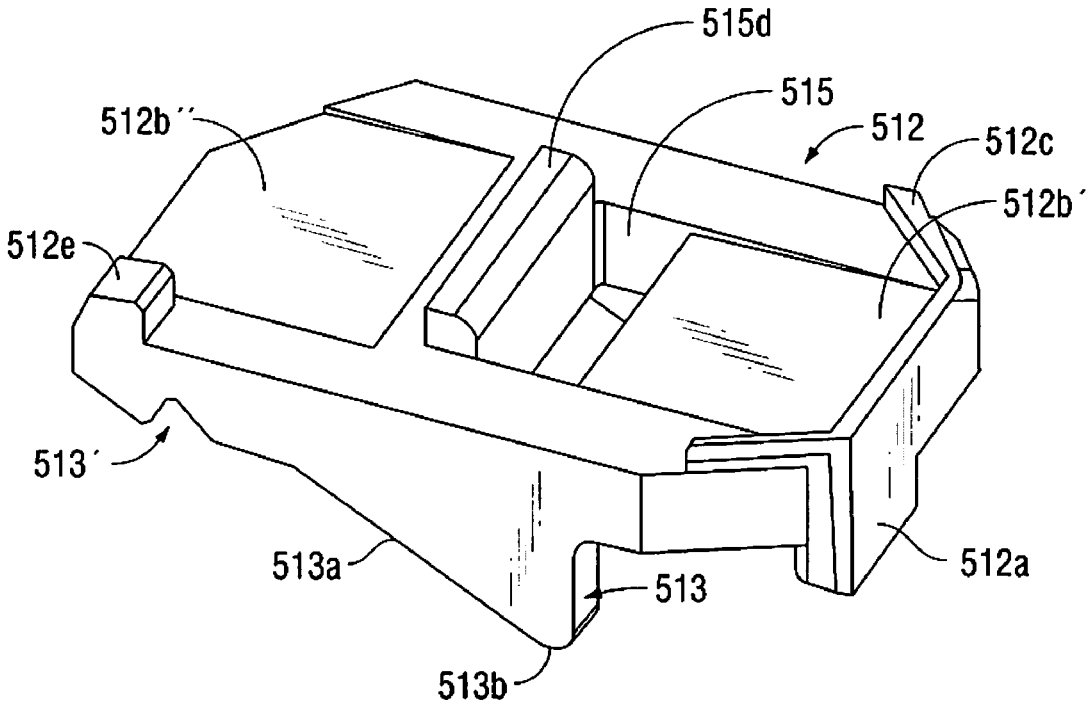
FIG. 45 is a top perspective view of a slider of the platform subassembly of FIGS. 43 and 44.
Figure 46:
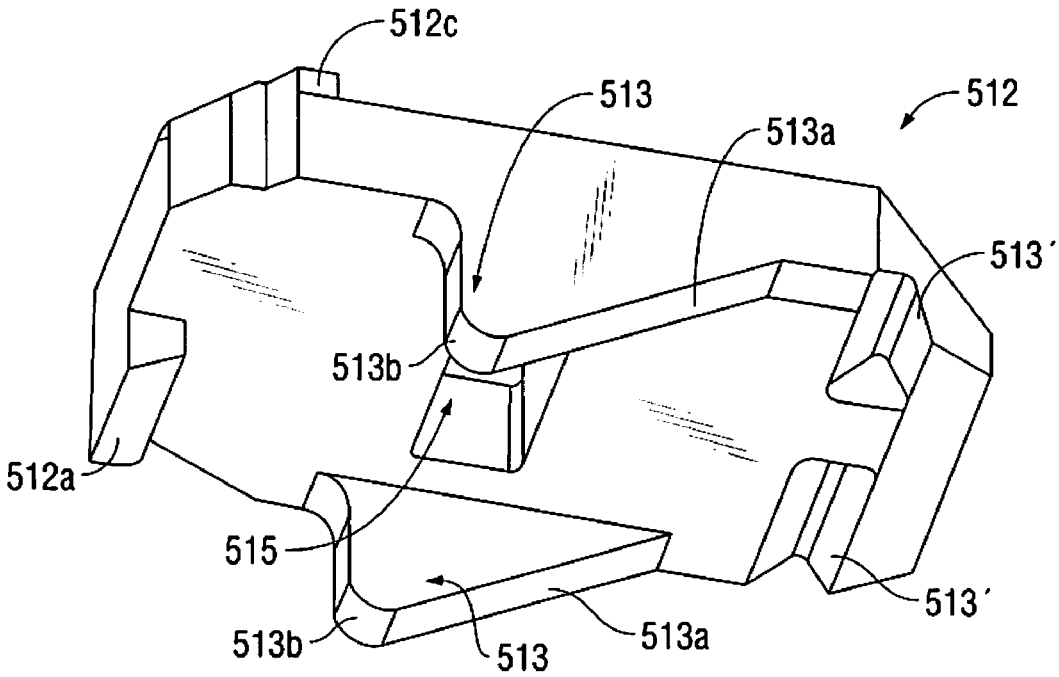
FIG. 46 is a bottom perspective view of the slider of FIG. 45.

As seen in FIGS. 43-46, slider 512 includes a pair of slide ribs 513 projecting from a bottom surface thereof. Each rib 513 defines an angled, tapered or sloped proximal surface 513*a* spaced a distance from the bottom surface of slider 512. Each angled surface 513*a* of ribs 513 terminates in a rounded distal end 513*b*, as seen in FIGS. 45 and 46, or a point as shown in FIG. 44.

As seen in FIGS. 44 and 46, slider 512 further includes at least one pocket 513', axially spaced from ribs 513 in the direction of angled surface 513*a*, formed in a bottom surface thereof. Pocket 513' defines a first locking feature for slider 512.

As seen in FIGS. 44 and 46, slider 512 further includes at least one tab 512*a* projecting from a bottom surface thereof and being located near a distal edge thereof. Tab 512*a* defines a surface against which biasing member 514 may act.

As seen in FIGS. 43-46, slider 512 further includes a slider aperture 515 formed therein to enable one prong to be inserted therethrough to make contact with the receptacle terminals in the base of the tamper resistant receptacle 540. As mentioned above, cover 520 of receptacle 540 may include at least one pair of apertures. As such, slider aperture 515 must align with at least one of the apertures from an aperture pair of cover 520 to enable a prong to pass through the slider aperture 515 to a receptacle terminal, as described above.

As seen in FIG. 45, a top surface of slider 512 defines a pair of angled surfaces 512*b*', 512*b*" extending into slider 512. Angled surfaces 512*b*', 512*b*" are oriented in a pair of parallel planes. As seen in FIG. 45, angled surface 512*b*' begins near or at a proximal edge of slider 512 and extends through to slider aperture 515, meanwhile, angled surface 512*b*" begins at a location spaced a distance distal of slider aperture 515 and extends through a distal edge of slider 512.

With continued reference to FIGS. 43-46, slider 512 includes a proximal-most wall 512*c* extending from an upper surface thereof at the proximal edge thereof. Slider 512 further includes an intermediate wall 512*d* extending from the upper surface thereof at a location extending from a distal edge of slider aperture 515. Slider 512 further includes a distal pin or catch feature 512*e* extending from the upper surface thereof at the distal edge thereof.

Figure 47:
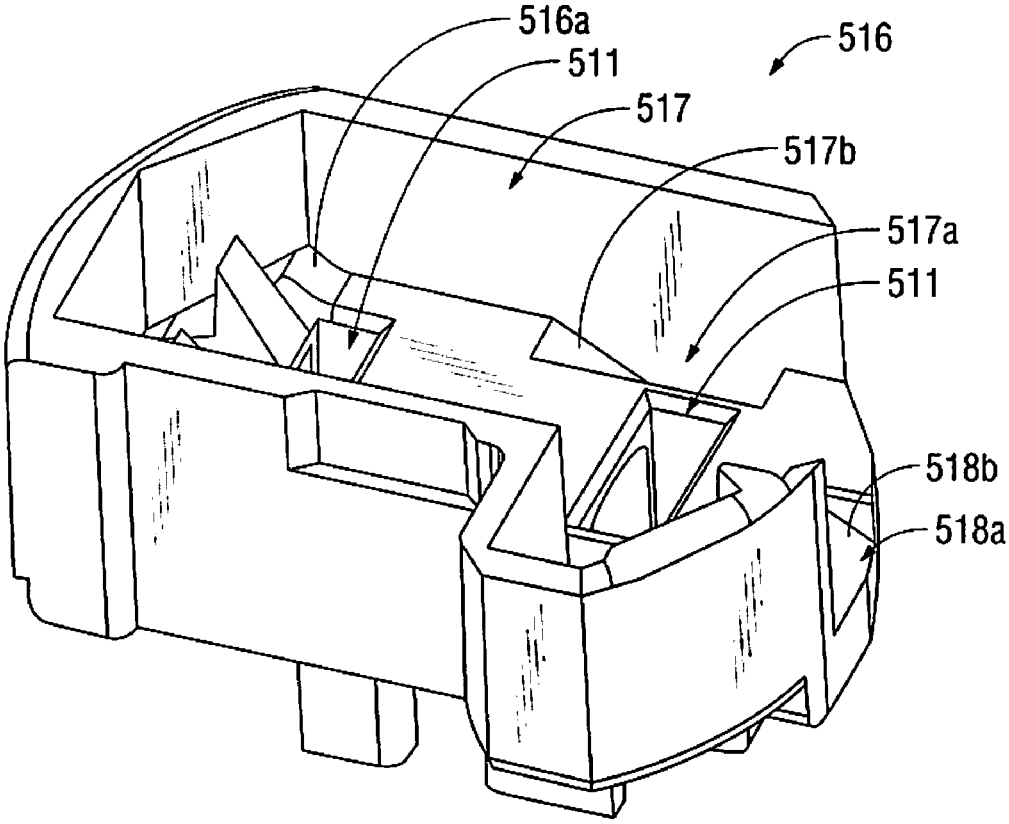
FIG. 47 is a perspective view of a platform of the platform subassembly of FIGS. 43 and 44.
Figure 48:
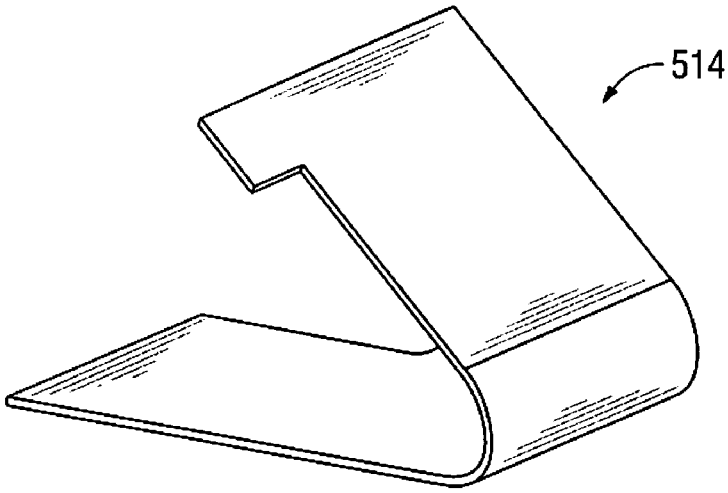
FIG. 48 is a perspective view of a biasing member of the platform subassembly of FIGS. 43 and 44.

As seen in FIGS. 43, 44 and 47, platform 516 includes a pair of apertures 511 formed in a bottom surface of pocket 517. Pocket 517 defines a pair of recesses 517*a* therein, at a location flanking the pair of apertures 511. Recesses 517*a* of platform 516 are configured and dimensioned to selectively receive and accommodate ribs 513 of slider 512 therein. Each recess 517*a* defines an angled or sloped rear wall 517*b*, defining a camming surface for engagement and/or contact with angled surface 513*a* of ribs 513.

Pocket 517 may further define a second recess 518*a* at a location adjacent one of the pair of apertures 511, preferably on a side located near or at a distal end of platform 516. Second recess 518*a* may also an angled or sloped rear wall 518*b*, defining a camming surface for engagement and/or contact with tab 512*a* projecting from slider 512, as described above.

Platform 516 includes a ramp feature 516*a* projecting from and bottom wall thereof at a location near a proximal aperture of the pair of apertures 511. Ramp feature 516*a* may be located adjacent a first side edge of the proximal aperture of the pair of apertures 511. Platform 516 further includes a pin or capture feature 516*b* projecting from and bottom wall thereof at a location near the proximal aperture of the pair of apertures 511. Capture feature 516*b* may be located adjacent a second side edge of the proximal aperture of the pair of apertures 511.

Biasing member 514, in the form of a leaf spring, is mounted in cavity 517 of platform 516 in a manner so as to bias or hold slider 512 in place in a first position wherein aperture 515 of slider 512 is misaligned with either aperture 511 of platform 516.

Assembly of platform subassembly 510 is accomplished in a manner substantially similar to platform subassembly 10 and thus will not be described in further detail herein.

Figure 49A:
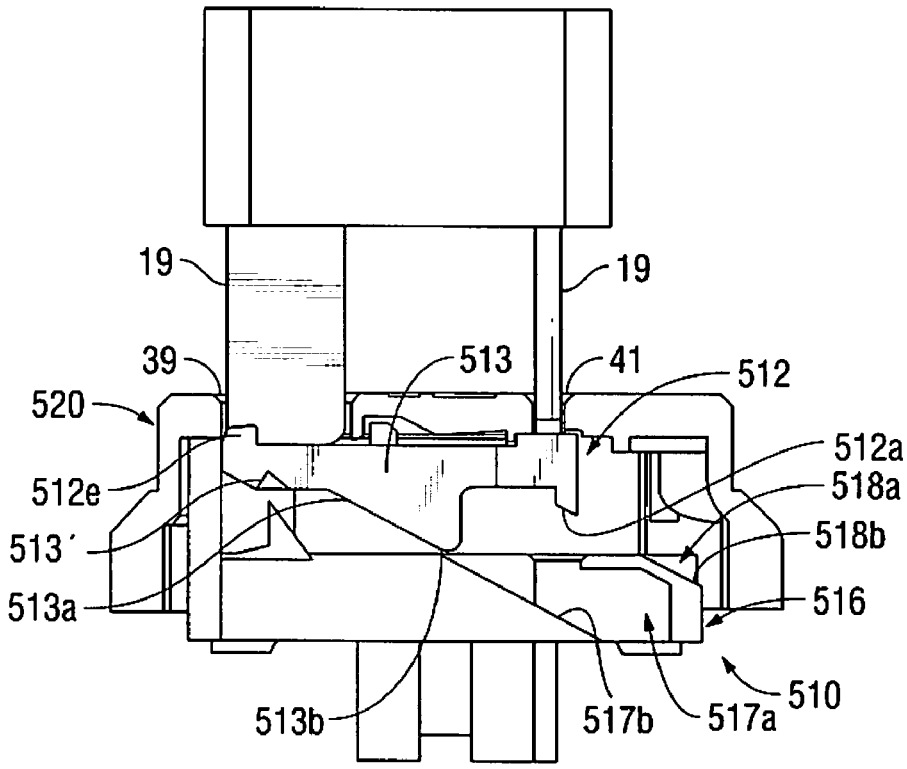
FIGS. 49A and 49B show the platform subassembly of FIGS. 43-48, when a pair of prongs from an electrical appliance are inserted into the pair of apertures in the cover at a common depth.
Figure 49B:
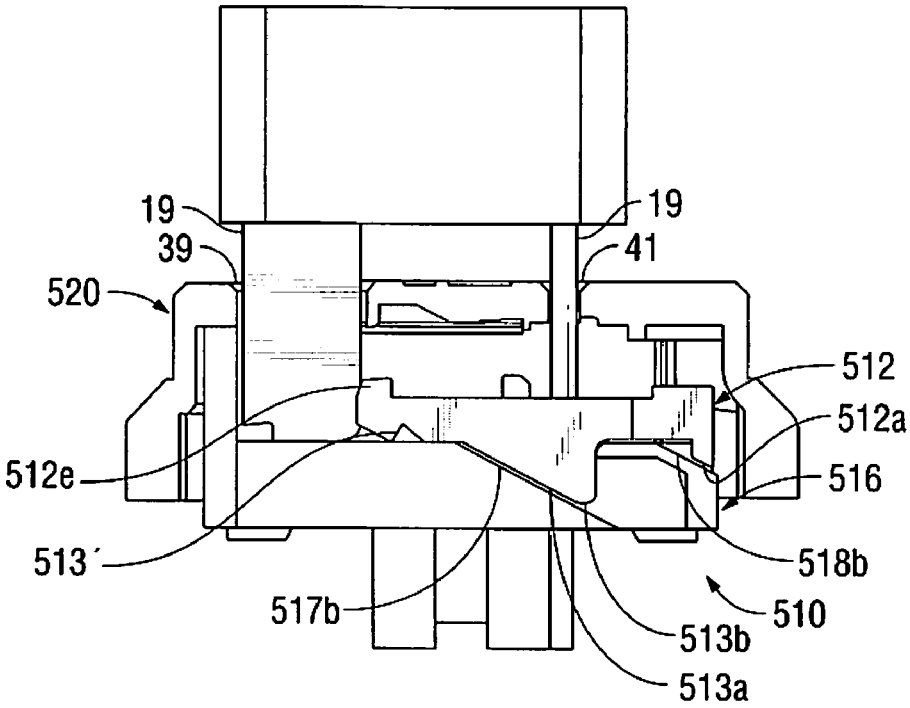

Turning now to FIGS. 49A and 49B, operation of platform subassembly 510 in a receptacle, upon insertion of an electrical plug in the receptacle 540, is shown and described. As seen in FIGS. 49A and 49B, platform subassembly 510 is housed within receptacle 540 (see FIG. 43) at a location between cover 520 and base 556 (including contacts 552).

As shown in FIG. 49A, just prior to having a pair of prongs inserted through the apertures in cover 520, slider 512 blocks direct entry into the receptacle terminals 552. This first position for slider 512 is referred to as a misaligned position. As prongs 19 are inserted further, ribs 513 of slider 512 slide into a second position down respective slopes or camming surfaces 517*b* of recesses 517*a* formed in platform 516 such that aperture 515 of slider 512 comes into alignment with one of the prongs 19.

As shown in FIG. 49B, slider 512 is illustrated in the second position (i.e., an alignment position). As shown in FIG. 49B, ribs 513 slide down slope 517*b* of recess 517*a* and tab 512*a* slides down slope 518*b* of recess 518*a* thereby bringing aperture 515 of slider 512 in alignment with one of prongs 19. With slider 512 transitioned completely to the second position, slider 512 aligns with the cover apertures to allow a first prong of prongs 19 to bypass along a side of slider 512 and a second prong of prongs 19 to pass through aperture 515 of slider 512.

As such, the width of slider 512 is designed such that the other prong gains clearance straight through to the receptacle terminal when aperture 515 of slider 512 aligns with the aperture in cover 520. Thus, for this embodiment, the width between aperture 515 of slider 512 and a far end of slider 512 should be substantially equal to the width that exists between the apertures in cover 520. The first and second prongs 19 engage with receptacle terminals 552 to complete electrical contact with 540 once slider 512 has transitioned completely to the second position.

As slider 512 is transitioning from the first position to the second position, slider 512 acts on biasing member 514 to thereby bias biasing member 514. Biasing member 514 is designed to retract to its original position after being biased similar to a conventional spring. Thus, when the prongs 19 are withdrawn, biasing member 514 springs slider 512 back to the first position.

As seen in FIGS. 45 and 46, in an embodiment, if each angled surface 513*a* of ribs 513 terminates in a rounded distal end 513*b*, "picking" of slider 512 against platform 516 may be reduced and operability or slidability may be improved.

Figure 50A:
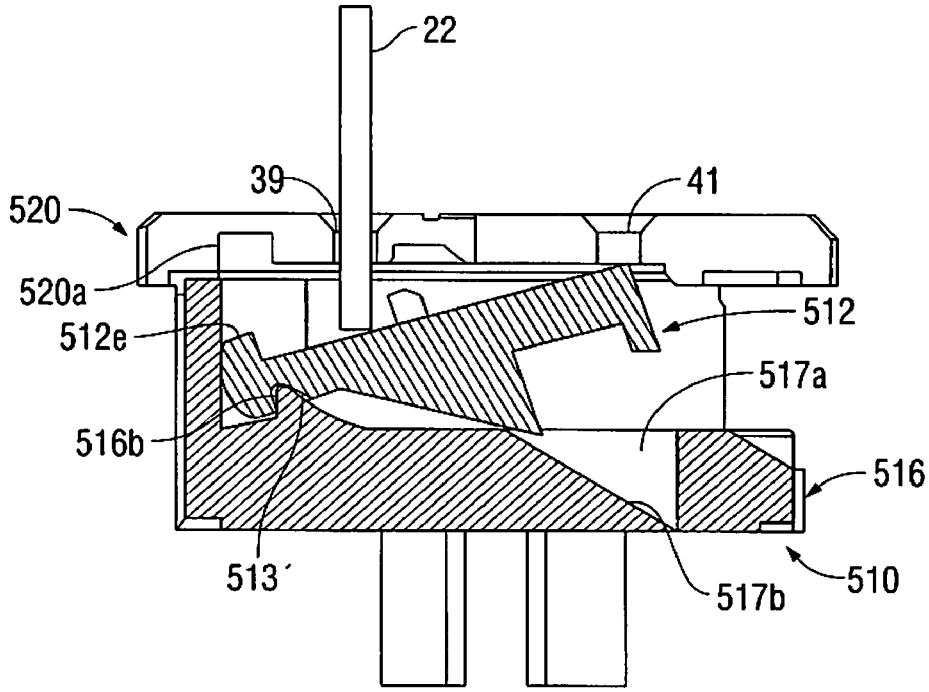
FIGS. 50A and 50B show the platform subassembly of FIGS. 43-48, when a single object is used to probe an aperture of the cover.
Figure 50B:
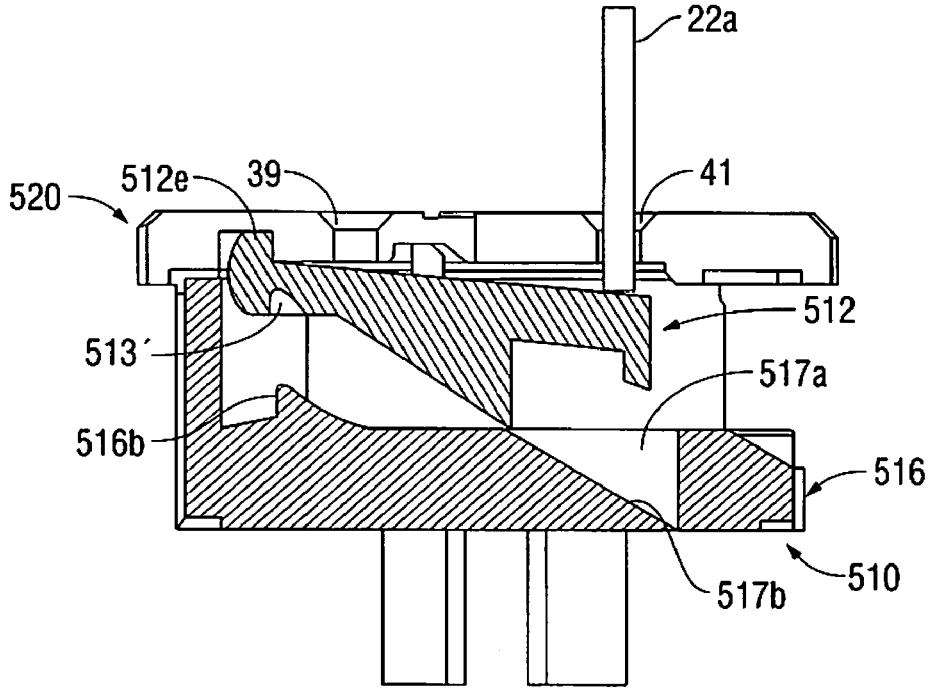

Turning now to FIGS. 50A-50B, there is illustrated what happens when a simple straight insertion is attempted only through one of the pair of cover apertures 39 or 41. In this case, when an object is inserted into either aperture 39 or 41, slider 512 remains confined in the misaligned position or the first position. Specifically, as seen in FIG. 50A, when an object 22 is inserted into aperture 39 of cover 520, object 22 pushes a proximal end of slider 512 down in the direction of platform 516 and restricts slider 512 from further movement down surface 517*b* of recess 517*a* of platform 516 due to the insertion of capture feature 516*b* of platform 516 in pocket 513' of slider 512.

Capture feature 516*b* of platform 516 restricts the movement of slider 512, such that slider 512 just tilts or cants as opposed to moving to the second position. As a result, slider 512 is disabled from transitioning to the second position. Thus, object 22 which probes the electrical receptacle 540 fails to make contact with the accessible power of contacts 552 which form the receptacle terminal.

In the alternative, as seen in FIG. 50B, when an object 22*a* is inserted into aperture 41 of cover 520, object 22*a* pushes a distal end of slider 512 down in the direction of platform 516 and restricts slider 512 from further movement down surface 517*b* of recess 517*a* of platform 516 due to the insertion of catch feature 512*e* of slider 512 in a recess 520*a* formed in an inner surfaced of cover 520. Ledge 416' of platform 416 restricts the movement of slider 412, such that slider 412 just tilts or cants as opposed to moving to the second position. As a result, slider 412 is once again disabled from transitioning to the second position. Thereby, object 22*a* which probes the electrical receptacle 40 fails to make contact with the accessible power of contacts 52 which form the receptacle terminal.

Advantages of this design include but are not limited to a tamper-resistant electrical wiring device system having a high performance, simple, and cost effective design.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A platform/slider subassembly for use in a tamper resistant receptacle including a cover having at least a set of apertures, the platform/slider subassembly comprising:

a platform defining a cavity having a base surface within said cavity, at least part of said base surface including an angled surface;

a slider reciprocally disposed within the cavity of the platform, the slider defining at least one aperture therein and at least one angled surface, wherein the angled surface of the slider cooperates with the angled surface of the platform, the slider being movable between a first position in which the slider blocks the set of apertures formed in the cover and a second position in which the slider does not block the set of apertures formed in the cover; and a biasing member interposed between the platform and the slider so as to urge the slider to the first position.

2. The platform/slider subassembly according to claim 1, wherein when a set of prongs in a plug is inserted simultaneously through the set of apertures formed in the cover, the prongs make contact with a surface on the slider urging the angled surface of the slider to cam against the angled surface of the platform such that the slider is urged from the first position to the second position and such that the biasing member is biased, wherein when in the second position the slider aperture aligns with at least one of the apertures of the set of apertures of the cover to enable the set of prongs to move past the slider.

3. The platform/slider subassembly according to claim 1, wherein when an object probes at least one and fewer than all of the apertures of the cover, the slider is constrained in the first position.

4. The platform/slider subassembly according to claim 1, wherein the slider includes a first capture element and the platform includes a first capture element, wherein when an object probes at least one and fewer than all of the apertures of the cover, the slider is canted with respect to the platform such that the first capture element of at least one of the slider and the platform engages a respective complementary second capture element of the other of the slider and platform thereby blocking movement of the slider from the first position to the second position.

5. The platform/slider subassembly according to claim 4, wherein the first capture element of the slider is disposed at one of a distal edge and a proximal edge thereof.

6. The platform/slider subassembly according to claim 4, wherein the slider includes a pair of capture elements for blocking movement of the slider from the first position to the second position when a probe is inserted into one aperture of the set of apertures of the cover.

7. The platform/slider subassembly according to claim 4, wherein the slider includes the first capture element configured to selectively engage a capture element formed in the cover when a probe is inserted into one aperture of said set of apertures of the cover, thereby blocking movement of the slider from the first position to the second position.

8. The platform/slider subassembly according to claim 1, wherein the biasing member is a leaf spring having a first end acting on the platform and a second end acting on a surface of the slider so as to urge the slider to the first position.

9. The platform/slider subassembly according to claim 8, wherein the first end of the leaf spring is secured to the platform.

10. The platform/slider subassembly according to claim 8, wherein the first end of the leaf spring is captured in a pocket defined in the platform.

11. The platform/slider subassembly according to claim 1, wherein the slider and platform each include a complementary second capture element formed on or in a respective surface thereof for blocking movement of the slider from the first position to the second position when an object probes at least one and fewer than all of the apertures of the cover.

12. The platform/slider subassembly according to claim 1, wherein the angled surface of the slider defines at least one camming surface, and the angled surface of the platform defines at least one camming surface engageable with the camming surface of the slider, wherein upon simultaneous contact of a surface of the slider by the set of prongs of the plug through the set of apertures of the cover and movement of the slider in the direction of the platform, the camming surfaces inter-engage with one another and urge the slider from the first position to the second position.

13. The platform/slider subassembly according to claim 12, wherein the camming surfaces change the direction of the movement of the slider from a direction substantially aligned with an axis of insertion of the set of prongs of the plug to a direction substantially angled with respect to the axis of insertion of the set of prongs of the plug.

14. A tamper resistant receptacle including a cover defining at least a set of apertures, wherein the set of apertures are configured to receive a set of prongs of a plug, wherein the set of prongs of the plug define a pair of planes that are one of:

parallel to one another in the form of a 15 ampere plug; and orthogonal to one another in the form of a 20 ampere plug, the tamper resistant receptacle comprising:

a platform/slider subassembly disposed along to an inner surface of the cover, the platform/slider subassembly including:

a platform defining a cavity having a base surface within said cavity, at least part of said base surface including an angled surface;

a slider reciprocally disposed within the cavity of the platform and interposed between the cover and the platform, the slider defining at least one aperture therein and at least one angled surface, wherein the angled surface of the slider cooperates with the angled surface of the platform, the slider being movable between:

a first position in which the slider blocks the set of apertures formed in the cover; and a second position in which the at least one aperture of the slider aligned with at least one of the set of apertures formed in the cover such that the slider does not block the set of apertures formed in the cover; and a biasing member interposed between the platform and the slider so as to urge the slider to the first position.

15. The tamper resistant receptacle according to claim 14, wherein the distance between the first and second positions of the slider is substantially the same for 15 ampere and 20 ampere plugs.

16. The tamper resistant receptacle according to claim 14, wherein the slider is constrained in the first position when a non-suitable plug is inserted in at least one of the set of apertures.

17. The tamper resistant receptacle according to claim 14, wherein the slider includes a first capture element and the platform includes a first capture element, wherein the platform and slider capture elements engage each other to block movement of the slider when a non-suitable plug is inserted in at least one of the set of apertures.

18. The tamper resistant receptacle according to claim 17, wherein the first capture element of the slider is disposed at one of a distal edge and a proximal edge thereof.

19. The tamper resistant receptacle according to claim 17, wherein the slider includes a pair of capture elements for blocking movement of the slider from the first position to the second position when a probe is inserted into one aperture of the set of apertures of the cover.

20. The tamper resistant receptacle according to claim 17, wherein the slider includes the first capture element configured to selectively engage a capture element formed in the cover when a probe is inserted into one aperture of said set of apertures of the cover, thereby blocking movement of the slider from the first position to the second position.

21. The tamper resistant receptacle according to claim 14, wherein the biasing member is a leaf spring having a first end acting on the platform and a second end acting on a surface of the slider so as to urge the slider to the first position.

22. The tamper resistant receptacle according to claim 21, wherein the first end of the leaf spring is secured to the platform.

23. The tamper resistant receptacle according to claim 21, wherein the first end of the leaf spring is captured in a pocket defined in the platform.

24. The tamper resistant receptacle according to claim 14, wherein the slider and platform each include a complementary second capture element formed on or in a respective surface thereof for blocking movement of the slider from the first position to the second position when an object probes at least one and fewer than all of the apertures of the cover.

25. The tamper resistant receptacle according to claim 14, wherein the angled surface of the slider defines at least one camming surface, and the angled surface of the platform defines at least one camming surface engageable with the camming surface of the slider, wherein upon simultaneous contact of a surface of the slider by the set of prongs of one of the 15 ampere plug and the 20 ampere plug through the set of apertures of the cover and movement of the slider in the direction of the platform, the camming surfaces inter-engage with one another and urge the slider from the first position to the second position.

26. The tamper resistant receptacle according to claim 25, wherein the camming surfaces change the direction of the movement of the slider from a direction substantially aligned with an axis of insertion of the set of prongs of one of the 15 ampere plug and the 20 ampere plug to a direction substantially angled with respect to the axis of insertion of the set of prongs of one of the 15 ampere plug and the 20 ampere plug.

27. The tamper resistant receptacle according to claim 14, wherein the surface of the slider against which the set of prongs of one of the 15 ampere plug and the 20 ampere plug make contact is oriented substantially perpendicular to an axis of insertion of the set of prongs of one of the 15 ampere plug and the 20 ampere plug.

* * * * *